US007721353B2

(12) United States Patent
Saturnio

(10) Patent No.: US 7,721,353 B2
(45) Date of Patent: May 25, 2010

(54) HAND COVERING WITH A HOOD AND A MOVEMENT MECHANISM

(75) Inventor: Christopher Saturnio, Crofton, MD (US)

(73) Assignee: 180s, Inc., Baltimore, MD (US)

( * ) Notice: Subject to any disclaimer, the term of this patent is extended or adjusted under 35 U.S.C. 154(b) by 289 days.

(21) Appl. No.: 11/084,849

(22) Filed: Mar. 18, 2005

(65) Prior Publication Data

US 2006/0075540 A1 Apr. 13, 2006

Related U.S. Application Data

(60) Provisional application No. 60/554,134, filed on Mar. 18, 2004, provisional application No. 60/577,447, filed on Jun. 5, 2004.

(51) Int. Cl.
*A41D 19/00* (2006.01)

(52) U.S. Cl. ..... 2/160; 2/158; 2/163; 2/16

(58) Field of Classification Search ..... 2/160, 2/247, 249, 250, 224, 206, 16, 20, 21, 158; 15/227

See application file for complete search history.

(56) References Cited

U.S. PATENT DOCUMENTS

| | | | | |
|---|---|---|---|---|
| 137,988 | A | 4/1873 | Whipple | |
| 622,688 | A | 4/1899 | Horn | |
| 792,662 | A | 6/1905 | Liebenstein | |
| 1,216,877 | A | 2/1917 | Stewart | |
| 1,275,837 | A | 8/1918 | Biggs | |
| 1,286,771 | A | 12/1918 | Raymond | |
| 1,433,145 | A | 10/1922 | Muhlenbruch | |
| 1,680,592 | A | 8/1928 | Chiles | |
| 1,735,676 | A | 11/1929 | Elsey | |
| 1,786,227 | A | 12/1930 | Bruggeman | |
| 1,849,418 | A | 3/1932 | Chesebro | |
| 1,934,332 | A | 11/1933 | Skinner | |
| 1,970,081 | A | 8/1934 | Eisendrath | |
| 2,103,594 | A | 12/1937 | Murray | |
| 2,118,463 | A | 5/1938 | Eden | |
| 2,128,796 | A | 8/1938 | Bohm-Myro | |
| 2,242,318 | A | 5/1941 | Mosier | |
| 2,274,335 | A | 2/1942 | Kennedy | |
| 2,315,889 | A | 4/1943 | Wells | |
| 2,318,785 | A | 5/1943 | Kopplin | |
| 2,323,136 | A | 6/1943 | Johanson | |
| 2,432,325 | A * | 12/1947 | McDougall | 2/160 |
| 2,451,837 | A | 10/1948 | La Londe et al. | |

(Continued)

OTHER PUBLICATIONS

"SIGR8 and One—New Concept Gear" from the Takumi Corporation, five pages, Jan. 2004.

*Primary Examiner*—Gary L Welch
*Assistant Examiner*—Sally Colson Cline
(74) *Attorney, Agent, or Firm*—Edell, Shapiro & Finnan LLC

(57) ABSTRACT

A hand covering comprises a shell and a hood. The hood of the hand covering is selectively disposable in multiple configurations. In one configuration, the hood can be disposed so that it covers part of the finger portion. In another configuration, the hood can be disposed so that it does not cover the finger portion and the entire finger portion is exposed. In one embodiment, the hand covering includes a movement mechanism that can be manipulated to move the hood relative to the shell.

10 Claims, 25 Drawing Sheets

U.S. PATENT DOCUMENTS 2,566,580 A 9/1951 Patterson, Jr.
2,603,790 A 7/1952 Boehm-Myro
2,792,827 A 5/1957 Gravin et al.
2,937,377 A 5/1960 Mackay et al.
2,937,379 A 5/1960 Mackay et al.
3,098,237 A 7/1963 Slimovitz
3,299,441 A 1/1967 Slimovitz
3,403,408 A 10/1968 Helfer
3,649,966 A 3/1972 Shields
3,787,897 A 1/1974 Sabin et al.
3,879,764 A 4/1975 Weber-Liel
4,104,740 A 8/1978 Rinehart
4,186,445 A 2/1980 Stager
4,194,041 A 3/1980 Gore et al.
4,195,405 A 4/1980 Monk
4,224,692 A 9/1980 Sundberg
D259,200 S 5/1981 Small et al.
4,359,784 A 11/1982 Harrington
4,383,336 A 5/1983 Beckman et al.
4,430,759 A 2/1984 Jackrel
4,497,072 A 2/1985 Watanabe
4,503,565 A 3/1985 Lippitt, Jr. et al.
4,559,646 A 12/1985 Ertl
4,559,647 A 12/1985 Smith et al.
4,565,195 A 1/1986 Eisenberg
4,570,269 A 2/1986 Berlese
4,587,672 A 5/1986 Madnick et al.
4,603,439 A 8/1986 Golomb
4,651,350 A 3/1987 Dawiedczyk
4,654,895 A 4/1987 Peters
4,658,444 A 4/1987 Figlia et al.
4,662,006 A 5/1987 Ross, Jr.
4,670,909 A 6/1987 Forrester
4,698,851 A 10/1987 Dunford et al.
4,704,743 A 11/1987 Thornell et al.
4,733,412 A 3/1988 Campbell
4,742,580 A 5/1988 Phillips, Jr. et al.
4,759,084 A 7/1988 Madnick et al.
4,791,683 A 12/1988 Agee
4,805,338 A 2/1989 Schublom
4,813,082 A * 3/1989 Kallman ..... 2/158
4,843,644 A 7/1989 Sugarman
4,843,651 A 7/1989 Gramza et al.
4,850,052 A 7/1989 Matthews
4,918,756 A 4/1990 Grilliot et al.
4,933,992 A * 6/1990 Kallman ..... 2/160
4,959,881 A * 10/1990 Murray ..... 15/227
5,123,119 A 6/1992 Dube
5,184,353 A 2/1993 Goldwitz
5,187,815 A 2/1993 Stern et al.
5,373,585 A 12/1994 Wiggins
5,378,529 A 1/1995 Bourdeau
5,509,143 A 4/1996 Yates et al.
5,515,547 A * 5/1996 Middleton ..... 2/158
5,517,693 A 5/1996 Noonan
5,542,125 A 8/1996 Zuckerwar
5,572,739 A 11/1996 Kolada et al.
5,617,583 A * 4/1997 Yates et al. ..... 2/160
5,636,382 A 6/1997 Chopko et al.
5,682,613 A 11/1997 Dinatale
5,699,632 A 12/1997 Stout et al.
5,708,979 A 1/1998 Redwood et al.
5,732,413 A 3/1998 Williams
5,740,551 A 4/1998 Walker
5,745,916 A 5/1998 Linner
5,774,894 A * 7/1998 Yates et al. ..... 2/158
5,774,895 A 7/1998 Baldwin
5,787,506 A 8/1998 Wilder et al.
5,815,839 A 10/1998 Safford
5,867,830 A 2/1999 Chen
D410,956 S * 6/1999 Adams Zurawin ..... D29/113
5,920,908 A 7/1999 Widdemer
5,970,521 A 10/1999 Rabbeth
5,983,396 A 11/1999 Morrow et al.
6,004,662 A 12/1999 Buckley
6,035,444 A 3/2000 McGrew
6,065,155 A 5/2000 Sandusky
6,085,354 A 7/2000 Wilder et al.
6,122,769 A 9/2000 Wilder et al.
6,141,801 A 11/2000 Helenick
6,183,855 B1 2/2001 Buckley
6,189,150 B1 2/2001 Jones-Roberson
6,216,276 B1 4/2001 Eibert
6,233,742 B1 5/2001 Yungkurth
6,338,163 B1 * 1/2002 Markson ..... 2/163
6,370,693 B1 4/2002 Riccio
6,550,069 B1 4/2003 Morrow
6,581,211 B1 6/2003 Golden
6,643,844 B2 11/2003 Morrow et al.
6,715,151 B2 4/2004 Brockman
6,718,556 B2 4/2004 Zuckerwar et al.
6,810,530 B2 * 11/2004 Bryant, Sr. ..... 2/159
6,813,780 B2 11/2004 Morrow
2003/0154537 A1 8/2003 Carey et al.
2004/0064870 A1 4/2004 Gold

* cited by examiner

HAND COVERING WITH A HOOD AND A MOVEMENT MECHANISM

PRIORITY CLAIM TO RELATED APPLICATIONS

This application claims priority to U.S. Provisional Patent Application No. 60/554,134, entitled "Hand Covering With a Hood and a Movement Mechanism," filed Mar. 18, 2004. This application also claims priority to U.S. Provisional Patent Application No. 60/577,447, entitled "Hand Covering With a Hood and a Movement Mechanism," filed Jun. 5, 2004.

BACKGROUND OF THE INVENTION

This invention relates generally to a hand covering, and in particular, to a hand covering with a hood and a movement mechanism coupled to the hood to move the same.

Conventional hand coverings include a shell with a finger portion that is configured to receive the fingers of a user's hand. Some conventional hand coverings include a cover that can be disposed so as to cover part of the finger portion of the shell. The cover can be moved away from the finger portion to expose the finger portion. The adjustment of the cover relative to the shell in such conventional hand coverings is difficult.

Thus, a need exists for a hand covering that includes a hood that can be easily adjusted by the user. A need also exists for a hand covering with a hood that can be easily retracted while the hand covering is being worn by and used by the user.

SUMMARY OF THE INVENTION

A hand covering comprises a shell and a hood. In one embodiment, the hand covering is a glove. In another embodiment, the hand covering is a mitten. The shell includes a finger portion which may include one or more receptacles for one or more fingers of a user's hand. The hood of the hand covering is selectively disposable in multiple configurations. In one configuration, the hood can be disposed so that it covers part of the finger portion. In another configuration, the hood can be disposed so that it does not cover the finger portion and the entire finger portion is exposed.

In one embodiment, the hand covering includes a movement mechanism. The movement mechanism is coupled to the hood. The movement mechanism can be manipulated to move the hood relative to the shell. The movement mechanism can be manipulated to move the hood from a deployed configuration to a retracted configuration. In a deployed configuration, the hood covers part of the finger portion. In a retracted configuration, the hood does not cover the finger portion.

In one embodiment, the movement mechanism includes an elongate member. The elongate member can be coupled to the hood. In another embodiment, the elongate member is coupled to the hood and to the shell.

DETAILED DESCRIPTION

A hand covering comprises a shell and a hood. In one embodiment, the hand covering is a glove. In another embodiment, the hand covering is a mitten. The shell includes a finger portion which may include one or more receptacles for one or more fingers of a user's hand. The hood of the hand covering is selectively disposable in multiple configurations. In one configuration, the hood can be disposed so that it covers part of the finger portion. In another configuration, the hood can be disposed so that it does not cover the finger portion and the entire finger portion is exposed.

In one embodiment, the hand covering includes a movement mechanism. The movement mechanism is coupled to the hood. The movement mechanism can be manipulated to move the hood relative to the shell. The movement mechanism can be manipulated to move the hood from a deployed configuration to a retracted configuration. In a deployed configuration, the hood covers part of the finger portion. In a retracted configuration, the hood does not cover the finger portion.

In one embodiment, the movement mechanism includes an elongate member. The elongate member can be coupled to the hood. In another embodiment, the elongate member is coupled to the hood and to the shell.

Reference is made herein to the "palm side" and "back side" portions of a shell of a hand covering. The references to "palm side" and "back side" are intended to be representative of different sides of the shell. The term "back side" is used to identify the portion of a hand covering that covers the back of a user's hand inserted therein. The term "palm side" is used to identify the portion of a hand covering that covers the palm of a user's hand. The "palm side" and "back side" portions can be referred to as the "front side" and "back side" portions, respectively. Alternatively, the back side and the palm side can be referred to as the outside and the inside, respectively, of the hand covering.

Figure 1:
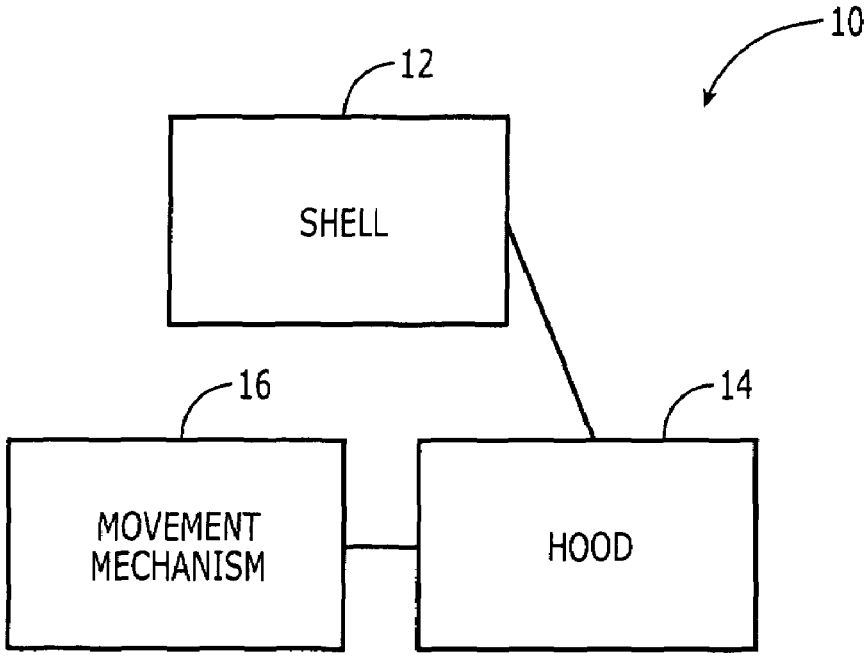
FIG. 1 is a block diagram of an embodiment of a hand covering according to the invention.

A functional block diagram of an embodiment of a hand covering according to the invention is illustrated in FIG. 1. The hand covering 10 includes a shell 12, a hood 14, and a movement mechanism 16. In this embodiment, the hood 14 is coupled to the shell 12, as represented by the line connecting the two elements. The hood 14 is also coupled to the movement mechanism 16. The movement mechanism 16 can be manipulated by a user to move the hood 14 relative to the shell 12. For example, the movement mechanism 16 can be adjusted to retract the hood 14.

The "shell" of a hand covering is any material that has a configuration into which a user can insert a portion of the user's hand. A shell may include one or more layers of the same or different materials. A shell may include a single material or multiple materials. For example, the hand covering may include an inner layer of material, an intermediate layer of material and an outer layer of material. In one embodiment, the intermediate layer of material can be an insulation type of material. Alternatively, a fluid such as air can be inserted between the inner and outer layers of material. In alternative embodiments, more than three layers of material can be provided. In such an alternative, the hand covering can include multiple intermediate layers. In alternative embodiments, the extent to which a user's hand is covered by the shell may vary.

In one embodiment, a shell includes a finger portion. A finger portion can include one or more receptacles that can receive one or more fingers of a user's hand. In one embodiment, the finger portion can include a single receptacle for multiple fingers, such as in a mitten. In another embodiment, the finger portion can include multiple receptacles, one for each of the fingers.

The term "hood" is intended to encompass a piece of material that can cover a portion of a hand covering. The "hood" can be referred to also as a cover, a protector, etc. A hood can be made of any material, such as a wind-resistant and/or water-resistant material. Examples of hoods are described in greater detail below.

In one embodiment, the hood 14 is fixedly coupled to the shell 12 using any conventional coupler or technique, such as sewing, adhesive, connectors, fasteners, etc. Similarly, the movement mechanism 16 is fixedly coupled to the hood 14 using any conventional coupler or technique. The term "fixedly coupled" means that to separate the coupled articles, either the coupler or one of the articles is destroyed.

In alternative embodiments, the hood can be removably coupled to the shell. Similarly, the movement mechanism can be removably coupled to the hood. The term "removably coupled" indicates that the coupled articles can be separated without destroying or damaging either of them. Such exemplary couplers or techniques that can be used to removably couple articles include magnets, hook and loop fasteners, snaps, clips, etc.

Figure 2:
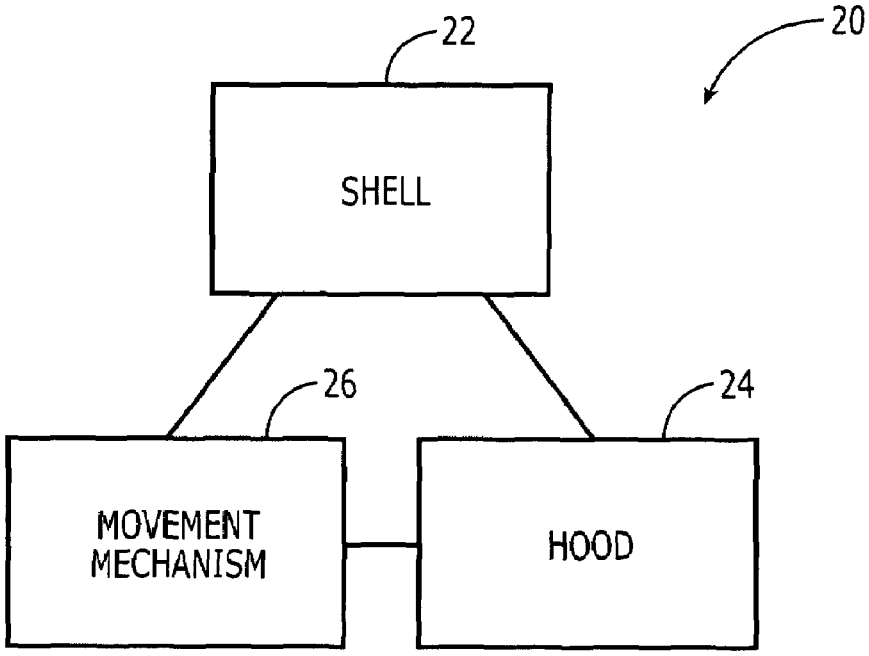
FIG. 2 is a block diagram of an alternative embodiment of a hand covering according to the invention.

An alternative embodiment of a hand covering according to the invention is illustrated in FIG. 2. The hand covering 20 includes a shell 22, a hood 24, and a movement mechanism 26. In this embodiment, the movement mechanism 26 is coupled to the shell 22 and the hood 24. The movement mechanism 26 can be manipulated to move the hood 24 relative to the shell 22.

Figure 3:
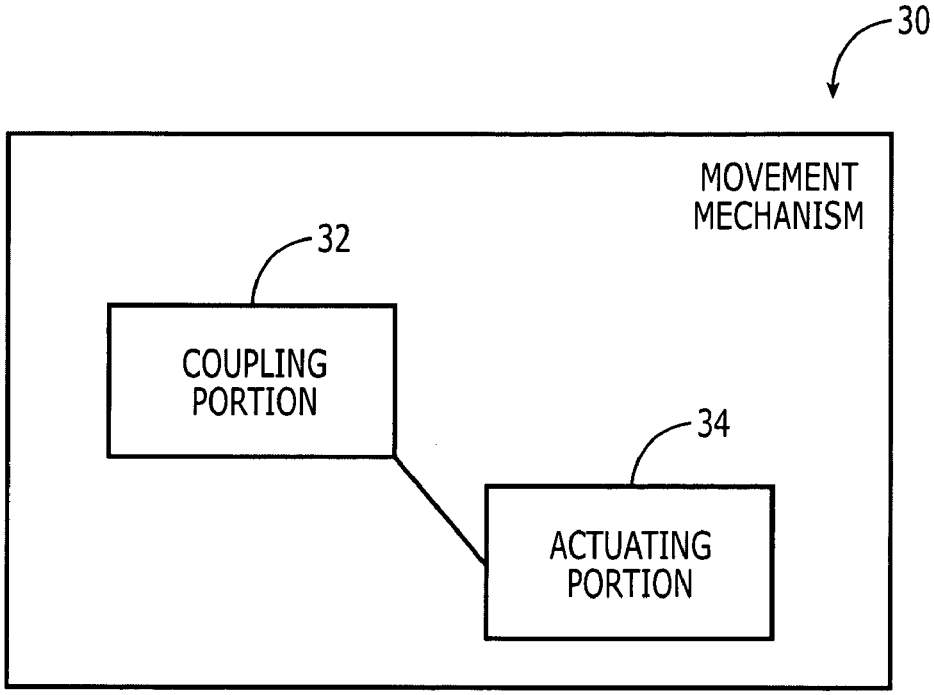
FIG. 3 is a block diagram of an embodiment of a movement mechanism according to the invention.

An embodiment of a movement mechanism according to the invention is illustrated in FIG. 3. In this embodiment, the movement mechanism 30 includes a coupling portion 32 and an actuating portion 34. The coupling portion 32 is coupled, either removably or fixedly, to a hood (not shown in FIG. 3). The actuating portion 34 is coupled to the coupling portion 32 and configured to be moved by a user to impart movement to the hood. As the actuating portion 34 moves, the coupling portion 32 and the hood move relative to the shell of the hand covering.

Figure 4:
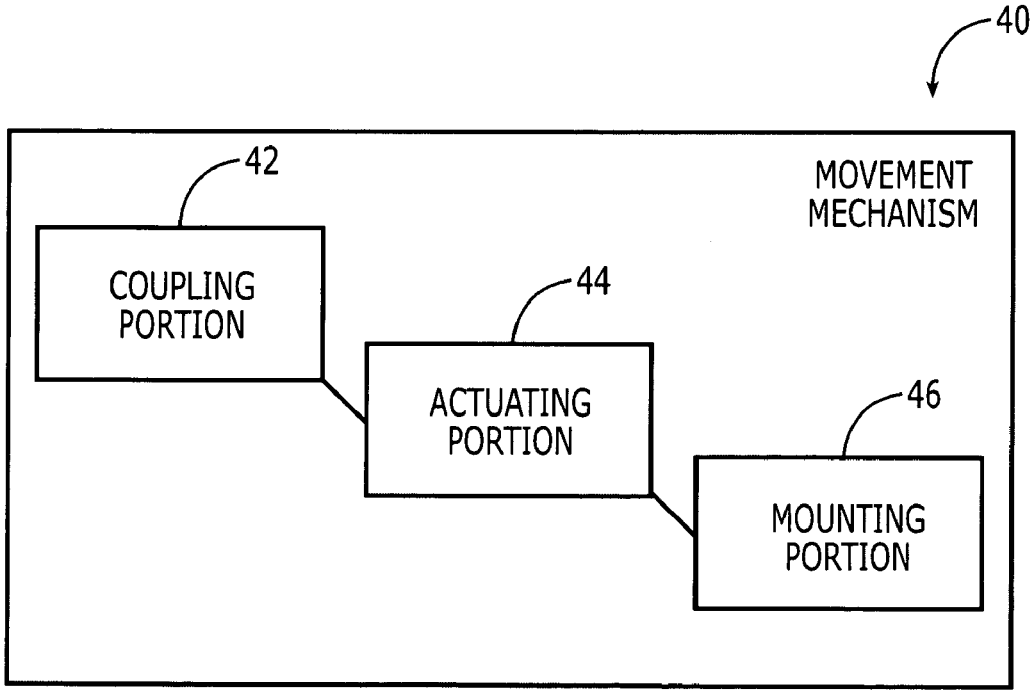
FIG. 4 is a block diagram of an alternative embodiment of a movement mechanism according to the invention.

An alternative embodiment of a movement mechanism according to the invention is illustrated in FIG. 4. In this embodiment, the movement mechanism 40 includes a coupling portion 42, an actuating portion 44, and a mounting portion 46. The mounting portion 46 is configured to be coupled to the shell using any conventional techniques.

Figure 5:
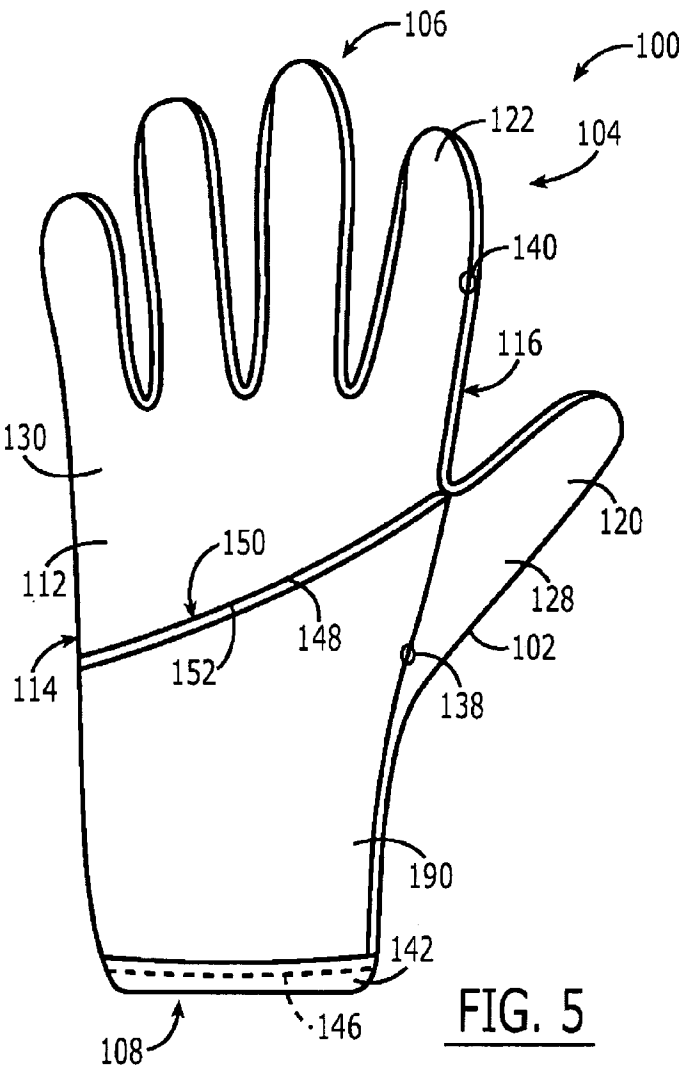
FIG. 5 is a top view of an embodiment of a hand covering according to the invention.

An embodiment of a hand covering according to the invention is illustrated in FIG. 5. In this embodiment, the hand covering 100 includes a shell 102 with a finger portion 104, a distal end 106, and a proximal end 108. The proximal end 108 is proximate to the user's arm when the hand covering 100 is disposed on the user's hand. The distal end 106 is the opposite end of the hand covering 100 from the proximal end 108.

The shell 102 includes a finger portion 104, which in this embodiment, includes a thumb receptacle 120 and several finger receptacles 122. The shell 102 includes side portions 114 and 116. The shell 102 also includes a palm side surface or portion 110 and a back side surface or portion 112.

The shell can include several different pieces that are coupled together to form the shell. In one embodiment, the shell can be formed by coupling together a front half portion and a back half portion. Alternatively, several different pieces and materials can be used depending on the desired functionality of the hand covering.

Figure 6:
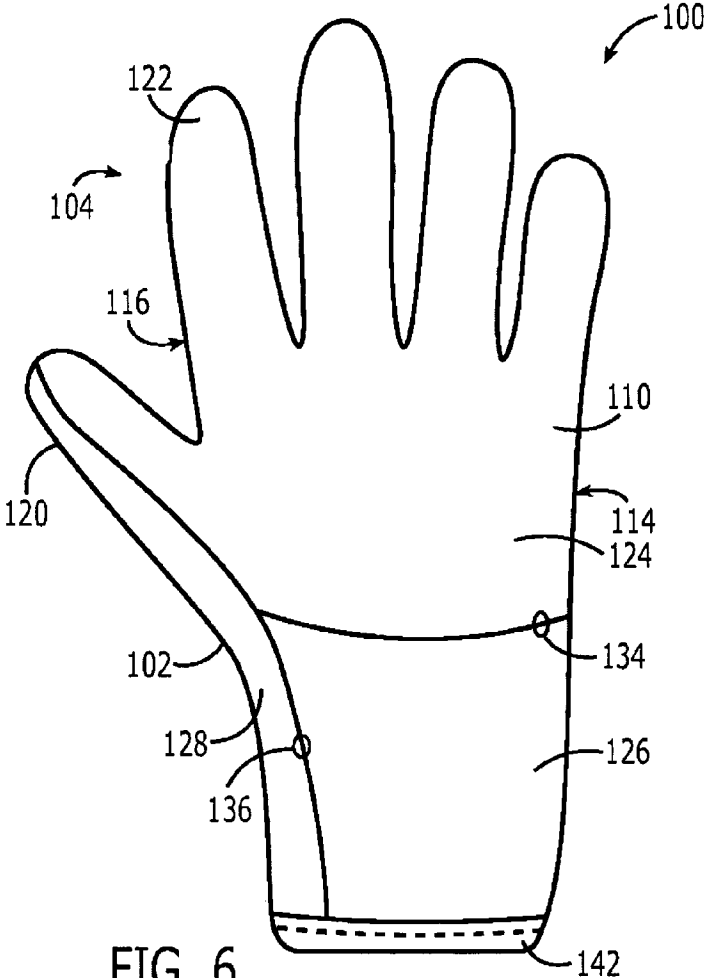
FIG. 6 is a bottom view of the hand covering illustrated in FIG. 5.

Referring to FIGS. 5 and 6, several components of an embodiment of the shell 102 are illustrated. While several different materials and configurations of multiple panels are described with reference to shell 102 of hand covering 100, any number of panels with different materials and configurations can be coupled together to form the shell in alternative embodiments.

Referring to FIG. 6, the shell 102 includes a palm panel 124 that forms the palm side portion 110 of the shell 102 and substantially covers the palm side of the user's hand, including the user's fingers. In one embodiment, the palm panel 124 is made of a breathable material. The breathability of the material allows the palm of the user's hand to cool when the user's fingers are extended. In one embodiment, the palm panel 124 includes multiple holes or openings that enhance the passage of air therethrough. In another embodiment, the palm panel 124 is a moisture-wicking material that can remove moisture or perspiration from the user's skin.

The shell 102 includes a wrist panel 126 that forms the remainder of the palm side portion 110 (see FIG. 6). In one embodiment, the wrist panel 126 is made from a moisture-wicking material. In an alternative embodiment, the wrist panel 126 is made from a wind-resistant material, which may or may not be a breathable material. The wrist panel 126 is coupled to the palm panel 124 along seam 134.

The cuff of the wrist portion of the hand covering 100 extends to the user's wrist to allow space for the use of electronic devices, such as stop watches and/or heart rate monitors.

The shell 102 includes a back panel 130 that forms the back side portion 112 of the shell 102 (see FIG. 5). The back panel 130 extends from the distal end 106 to the proximal end 108 of the shell 102. In one embodiment, the back panel 130 is made from a moisture-wicking material. In an alternative embodiment, the back panel 130 is made from a wind-resistant material, which may or may not be a breathable material. The back panel 130 is coupled to the palm panel 124 along seam 140.

The shell 102 includes a thumb panel 128 that forms part of the thumb receptacle 120. In one embodiment, the thumb panel 128 is made of an absorbent material, such as a terry cloth material. The absorbent material can function as a sweat or perspiration wipe. The thumb panel 128 is coupled to the back panel 130 along seam 138 and coupled to the palm panel 124 and wrist panel 126 along seam 136. The locations of seams 136 and 138 and the configuration of the thumb panel 128 enhance the mobility of the user's thumb.

The shell 102 includes an outer layer or panel 190 that forms a receptacle 150 with the outer surface of the back panel 130 and back side portion 112 of the shell 102. The outer panel 190 is made of an absorbent material, such as a terry cloth material. The absorbent material can function as a sweat or perspiration wipe with which the user can wipe a forehead or other part of the body. The outer panel 190 is coupled to the thumb panel 128 at seam 138. The outer panel 190 includes an end 148 that has a protective binding or piping 152 disposed thereon to reduce wear and fraying of the end 148. Binding 152 can be any material, including a reflective material.

The outer panel 190, back panel 130, thumb panel 128, and wrist panel 126 extend to the proximal end 108 of the shell 102. A binding 142 is disposed around the ends of the panels 190, 130, 128 and 126 and coupled thereto using stitching 146. In other embodiments, the ends of the panels 190, 130, 128, and 126 can be coupled together using any conventional device or technique, such as welding or an adhesive.

In one embodiment, each of the panels of the shell is cut or trimmed to a particular configuration and then the panels are sewn together. Other coupling devices and techniques can be used to couple the panels together. In alternative embodiments, the panels are welded together by heating the material of each panel, such as by ultrasonically welding the panels together. The panels can be coupled together in any order.

Figure 8:
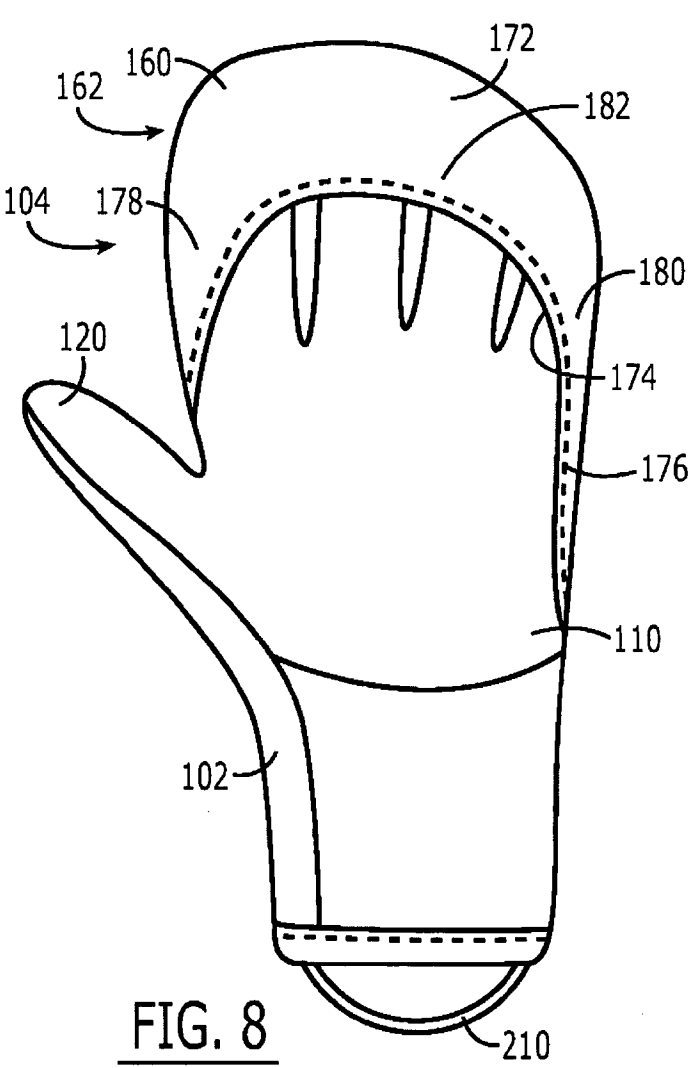
FIG. 8 is a bottom view of the hand covering illustrated in FIG. 7.
Figure 7:
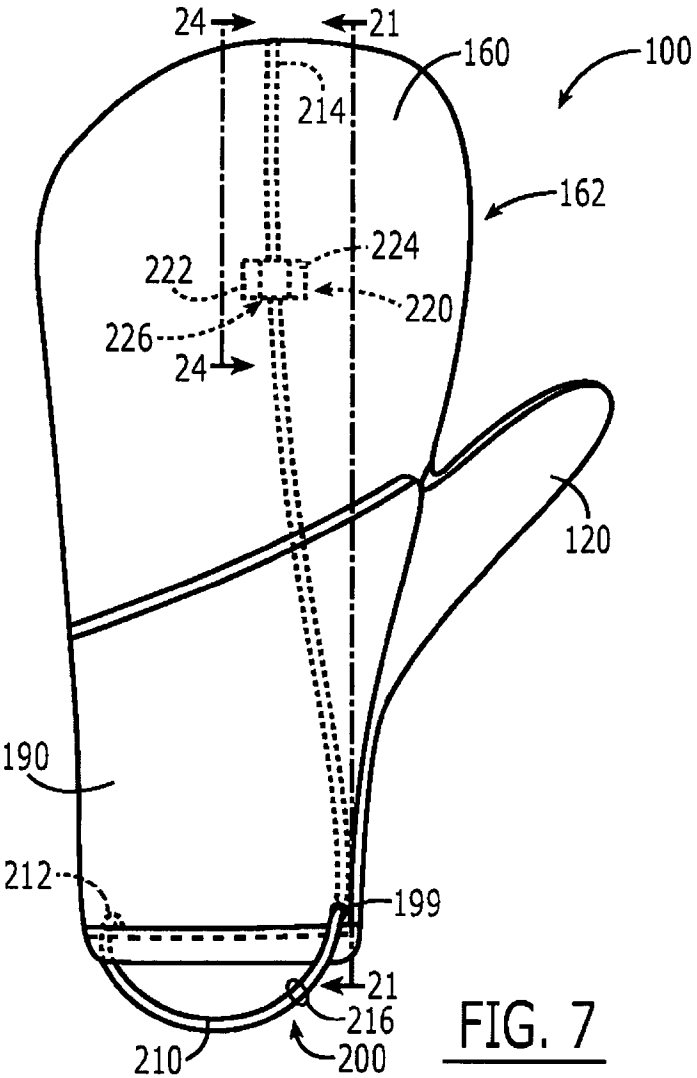
FIG. 7 is a top view of the hand covering illustrated in FIG. 5 in a different configuration.

An alternative embodiment of a hand covering according to the invention is illustrated in FIGS. 7 and 8. In this embodiment, the hand covering 100 includes a hood 160. The hood 160 is selectively disposable in different configurations with respect to the shell 102. The hood 160 is disposable in a deployed configuration 162 in which the hood 160 covers part of the finger portion 104. The hood 160 is also disposable in another configuration in which the hood 160 does not cover the finger portion 104 (see FIGS. 5 and 6 for reference in which the hood is in the receptacle 150). The hood 160 can be disposed in any configuration therebetween as well.

The hood 160 is made of a lightweight wind-resistant material that provides protection to the exposed area of the back of the hand covering. The hood 160 protects fingers and fingertips from a very low wind chill. The hood 160 also keeps the heat within key heat loss areas, such as the back of the user's hand and the fingertips. As the user's hand temperature increases, the hood 160 can be pulled back and stored in the receptacle.

Referring to FIG. 7, the hand covering 100 includes a movement mechanism 200. In this embodiment, the movement mechanism 200 includes an elongate member 210 that is coupled to the shell 102 and to the hood 160. The hood 160 can be retracted or moved from its configuration illustrated in FIG. 7 by pulling on the elongate member 210, as described in detail below.

The elongate member 210 has ends 212 and 214. The elongate member 210 also includes an actuating portion 216 that is disposed between ends 212 and 214. End 212 is coupled to the shell 102. In this embodiment, end 212 is disposed within an interior 147 of the binding 142 and coupled to the panels (see FIG. 21). End 214 is coupled to the hood 160 using any conventional device or technique. For example, the end 214 can be sewn to a fabric tab that is attached to the hood. Alternatively, the end 214 can be coupled directly to the hood.

Any material and size of elongate member can be used. In one embodiment, the elongate member is a nylon cord with a diameter of 2 millimeters.

The layer 190 includes an opening 199 located proximate to the proximate end 108 of the shell 102. The opening 199 is configured to receive the elongate member 210 as illustrated in FIG. 7.

In one embodiment, the hand covering 100 can include one or more guides that guide the path and movement of the elongate member. For example, guide 220 can be coupled to an inner surface of the hood 160. Guide 220 can include mounting portions 222 and 224 that are coupled to the hood 160, such as by sewing or an adhesive. Guide 220 includes a channel portion 226 through which the elongate member 210 passes. In alternative embodiments, multiple guides can be located on the inner surface of the hood.

A palm side view of the hand covering 100 is illustrated in FIG. 8. The hood 160 includes a covering portion 172 with an end 174. The covering portion 172 is sized so that the hood 160 covers part of the finger receptacles 122 when the hood 160 is in its deployed configuration 162. The covering portion 172 includes side portions 178 and 180 and a central portion 182. The end 174 of the hood 160 is folded over and sewn along seam 176.

The configuration of the end 174 can vary in different embodiments. In one embodiment, side portion 178 extends toward the proximal end 108 of the shell 102 so that the user can insert the thumb receptacle 120 beneath side portion 178 to disengage the finger receptacles 122 from the hood 160. The end 174 along the central portion 182 is curved toward the distal end 106 of the shell 102. The end 174 can be located closer to the distal end 106 than the seats of the finger receptacles 122, thereby facilitating the curling of the finger portion 104 and the hood 160 when the user closes the user's hand because of less material in that region. In another embodiment, the end 174 can extend closer to the proximal end 108 of the shell 102.

Figure 9:
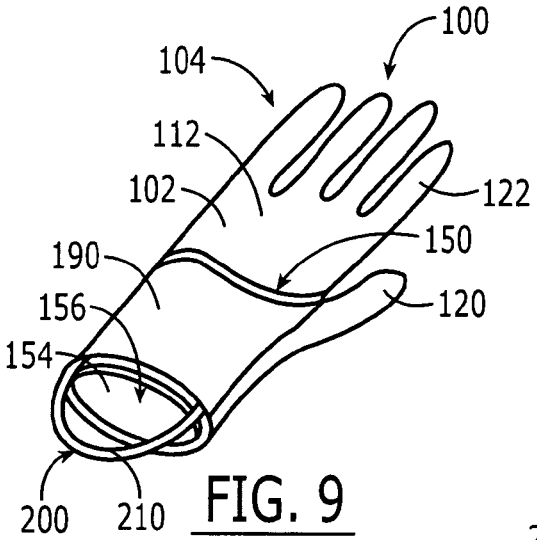
FIG. 9 is a perspective view of the hand covering illustrated in FIG. 7 in a first configuration.
Figure 10:
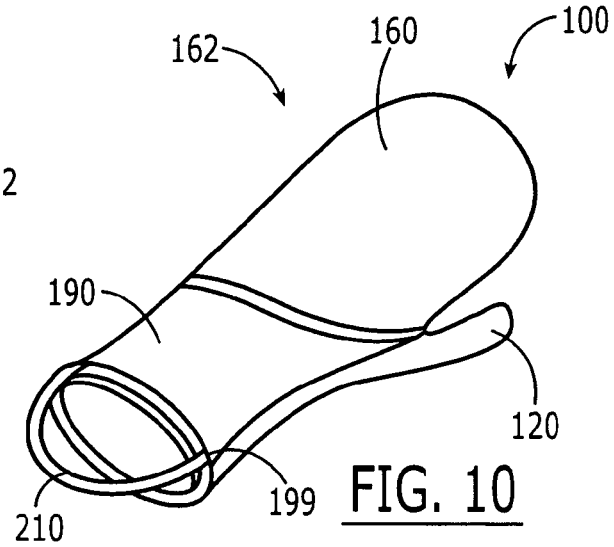
FIG. 10 is a perspective view of the hand covering illustrated in FIG. 7 in a second configuration.

Perspective views of the hand covering 100 in different configurations are illustrated in FIGS. 9 and 10. In FIG. 9, the hood 160 of the hand covering 100 is disposed in receptacle 150. In this location, the hood 160 is in its retracted configuration. In FIG. 10, the hood 160 of the hand covering 100 is disposed in its deployed configuration 162 in which it covers the finger portion 104.

Figure 11:
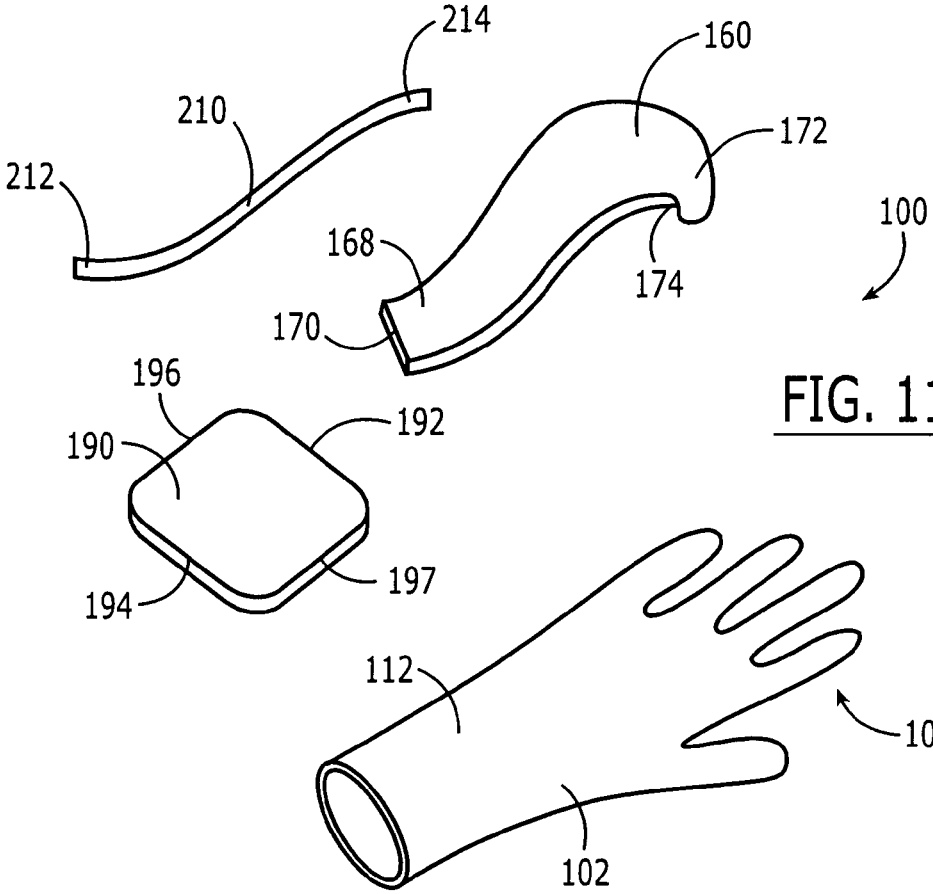
FIG. 11 is an exploded perspective view of the hand covering illustrated in FIG. 7.

Referring to FIG. 11, an exploded perspective view of the hand covering 100 is illustrated. The outer layer 190 includes a distal end 192, a proximal end 194, and side portions 196 and 197. The hood 160 includes a coupling portion 168 that is coupled to the shell 102. The coupling portion 168 is disposed proximate to an end 170.

Figure 12:
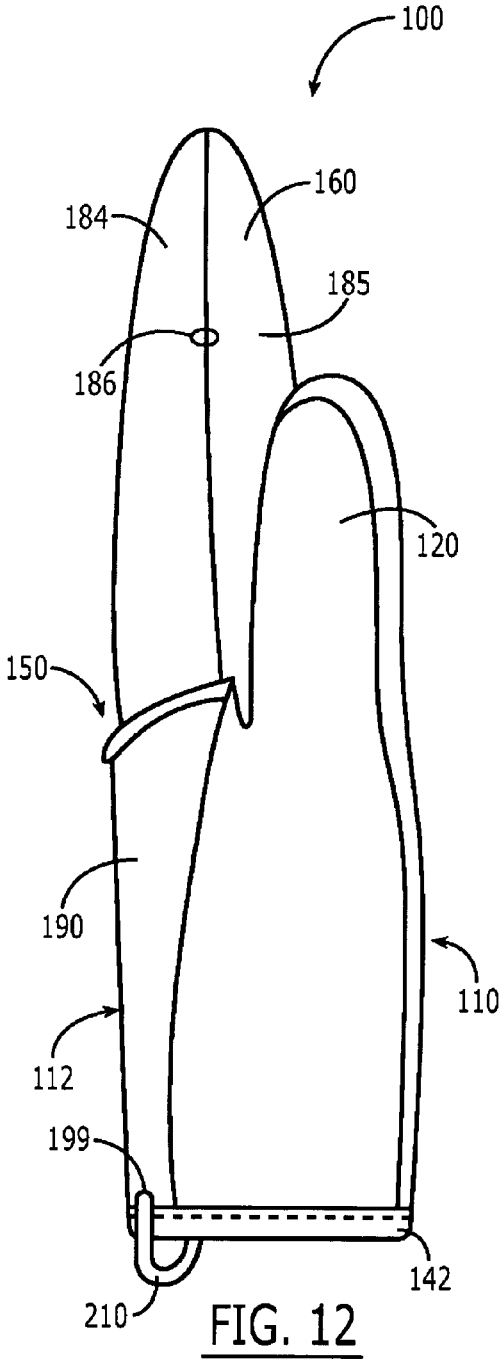
FIGS. 12 and 13 are opposite side views of the hand covering illustrated in FIG. 7.
Figure 13:
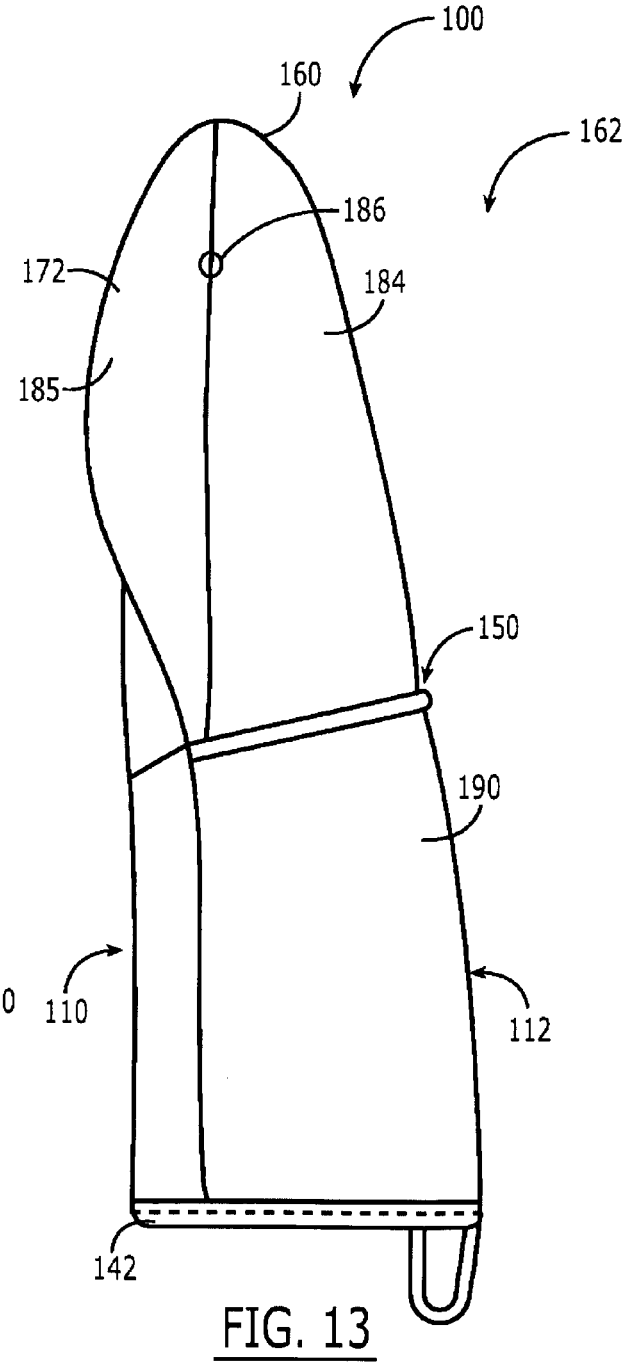

Referring to FIGS. 12 and 13, side views of the hand covering 100 are illustrated. The shell 102 has a palm side portion 110 and a back side portion 112. The hood 160 is illustrated in its deployed configuration 162 in which the covering portion 172 covers the finger portion 104. The hood 160 includes portions 184 and 185 that are coupled together along seam 186. In one embodiment, portions 184 and 185 can be sewn together.

Figure 14:
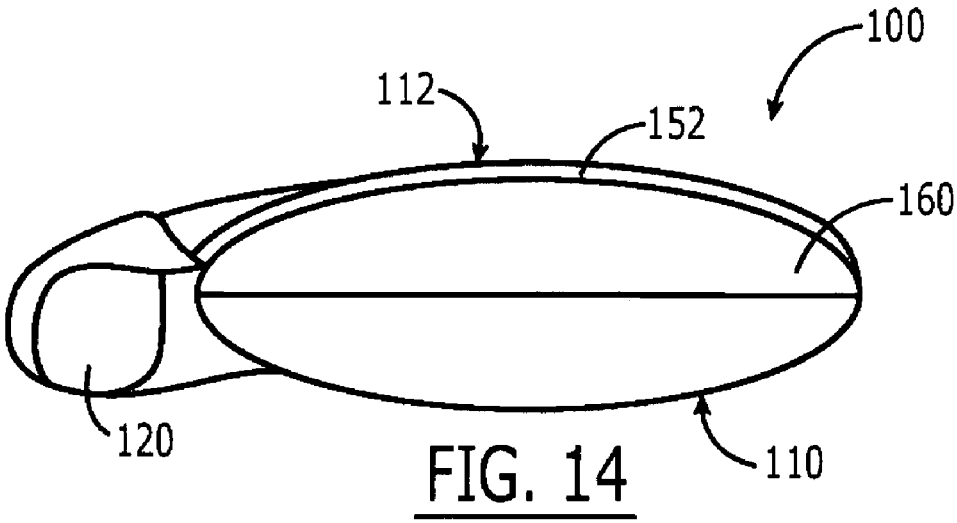
FIGS. 14 and 15 are opposite end views of the hand covering illustrated in FIG. 7.

A distal end view of the hand covering 100 is illustrated in FIG. 14. As illustrated, the hood 160 of the hand covering 100 extends around the finger receptacles 122. In this embodiment, the hood 160 does not cover the thumb receptacle 120.

Figure 15:
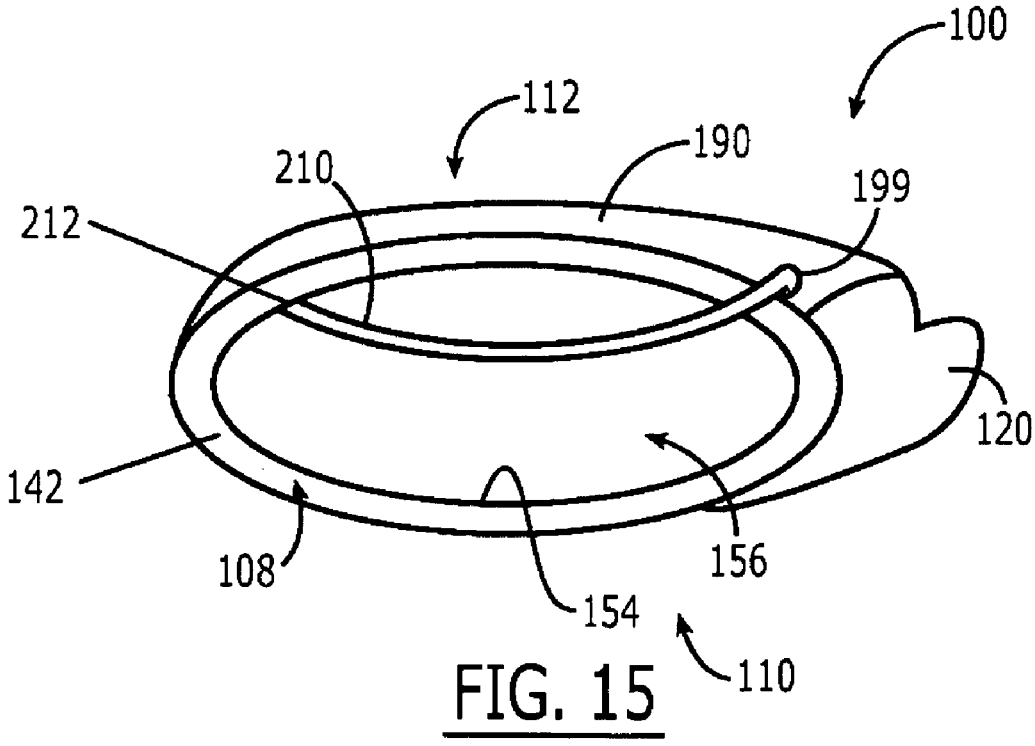

A proximal end view of the hand covering 100 is illustrated in FIG. 15. The hand covering 100 includes a shell 102 that has an inner surface 154 that defines an interior region 156 into which a user can insert a hand. The relative positions of end 212 of the elongate member 210 and the opening 199 of outer panel 190 are shown.

Figure 16:
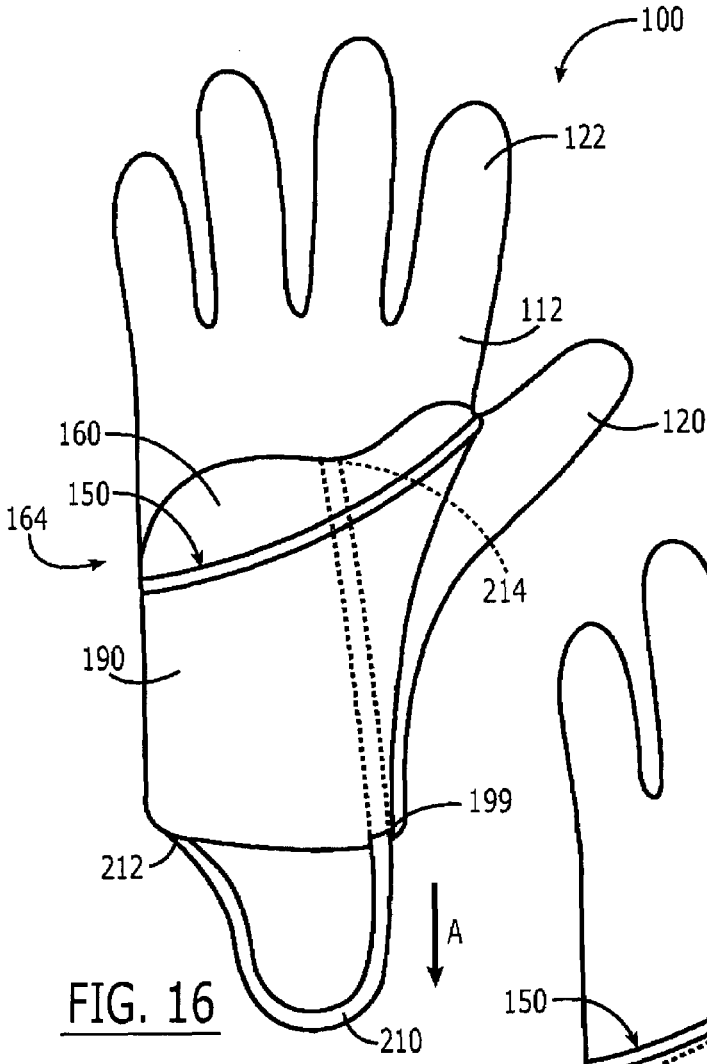
FIG. 16 is a top view of the hand covering illustrated in FIG. 7 in another configuration.

Referring to FIG. 16, the hood 160 of the hand covering 100 is illustrated in a partially retracted configuration. Once the hood 160 is disengaged from the finger receptacles 122, the hood 160 can be moved toward the proximal end 108 by pulling the elongate member 210 along the direction of arrow A. As the hood 160 is pulled to a partially retracted configuration 164, a portion of the hood 160 moves into the receptacle 150. As the hood 160 moves, a larger amount of the back side portion 112 of the hand covering 100 is exposed.

Figure 17:
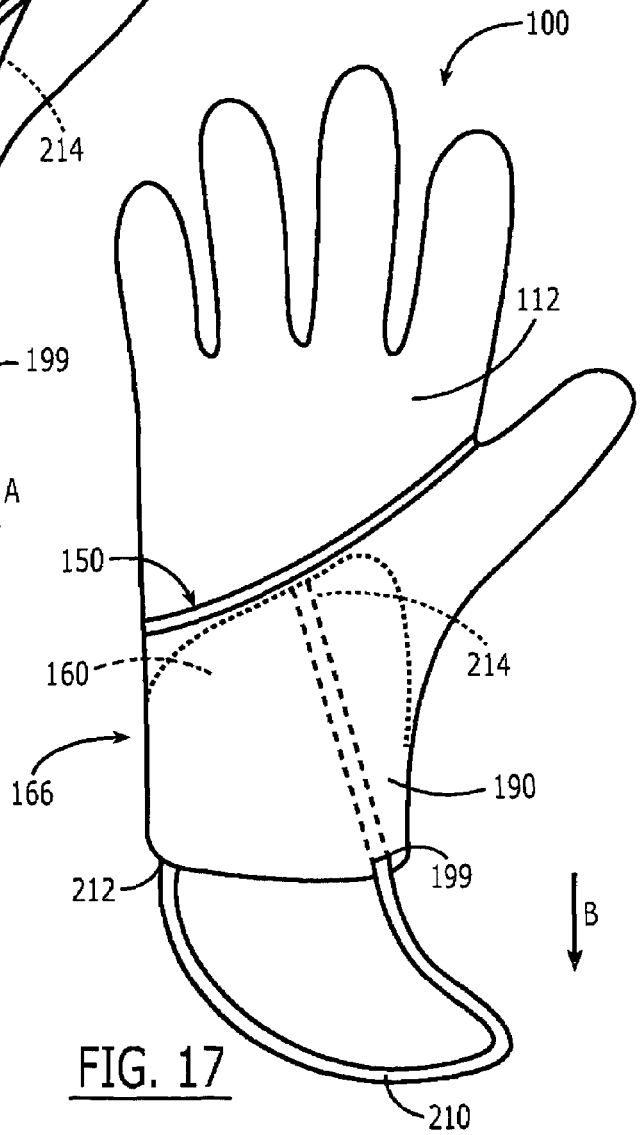
FIG. 17 is a top view of the hand covering illustrated in FIG. 7 in another configuration.

Referring to FIG. 17, the hood 160 of the hand covering 100 is illustrated in a fully retracted configuration 166. When a user continues to pull on the elongate member 210 along the direction of arrow B, the hood 160 is pulled into the receptacle 150 into its retracted configuration 166.

Figure 18:
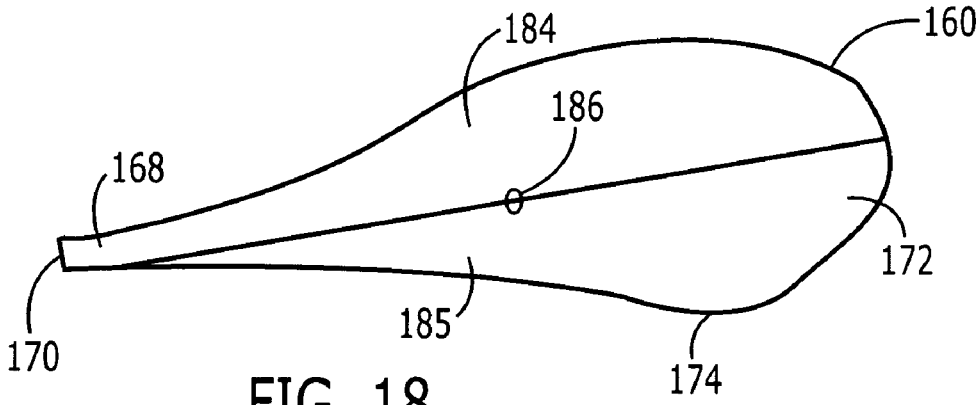
FIG. 18 is a side view of the hood of the hand covering illustrated in FIG. 7.
Figure 19:
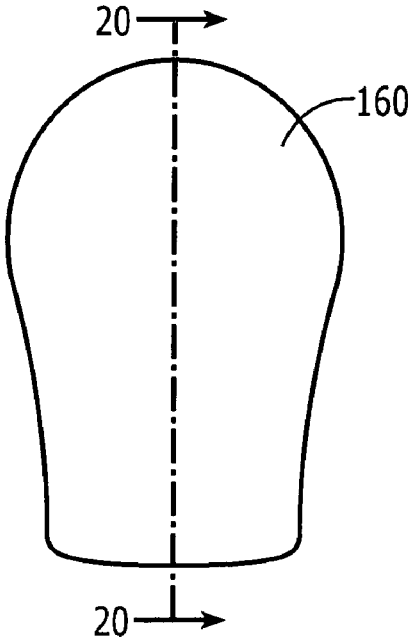
FIG. 19 is a top view of the hood illustrated in FIG. 18.
Figure 20:
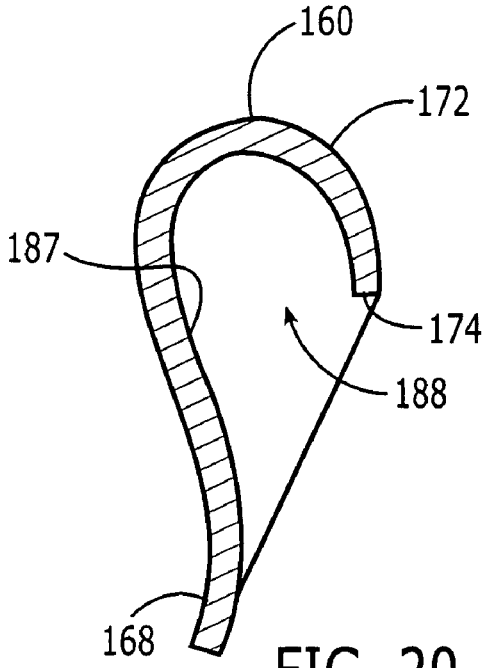
FIG. 20 is a cross-sectional side view of the hood illustrated in FIG. 19 taken along line "20-20".

The hood 160 is illustrated in more detail in FIGS. 18-20. In this embodiment, the hood 160 includes a coupling portion 168 proximate to end 170 and a covering portion 172 that has an end 174. As previously described, the extent to which the covering portion 172 of the hood 160 covers the finger receptacles 122 can vary. In one embodiment, the end 174 extends toward end 170 sufficiently so that the covering portion 172 covers the entire length of the finger receptacles 122. While hood 160 is illustrated as comprising two portions, one or more portions can be used and/or coupled together to form the hood in alternative embodiments.

Referring to FIG. 20, the hood 160 includes an inner surface 187 that defines an interior region 188. The inner surface 187 and interior region 188 can have any configuration that can accommodate the finger receptacles 122 of the hand covering 100.

Figure 21:
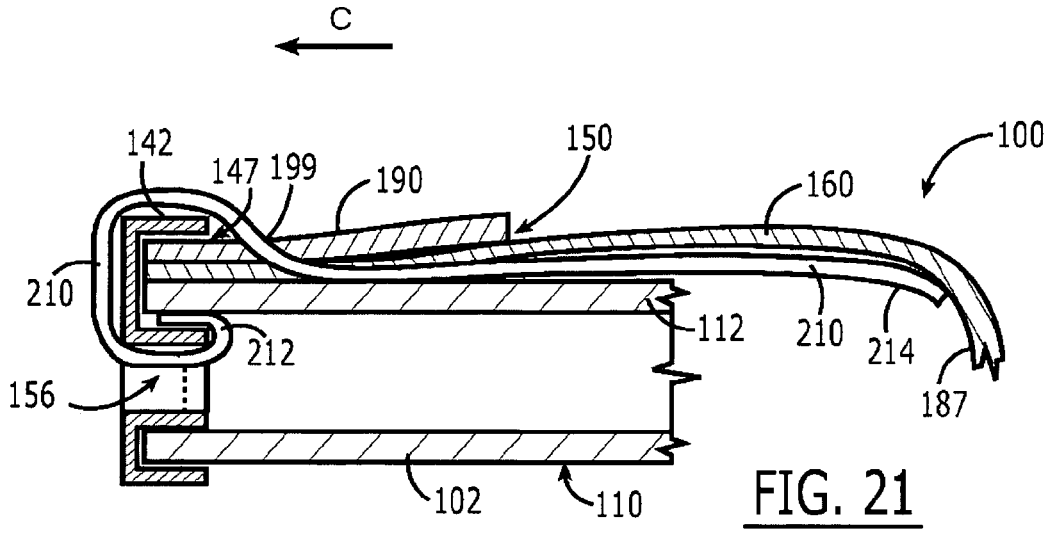
FIG. 21 is a cross-sectional side view of a portion of the hand covering illustrated in FIG. 7 taken along line "21-21".

Referring to FIG. 21, a partial cross-sectional view of some of the components of hand covering 100 is illustrated. This cross-sectional view is taken along the line "21-21" in FIG. 7. As shown, the shell 102 has a palm side portion 110 and a back side portion 112. The outer layer 190 forms a receptacle 150 with the back side portion 112 to receive the hood 160. A portion of the hood 160 is disposed in and coupled within the receptacle 150 such as by sewing. For example, the coupling portion 168 of the hood 160 is coupled to the shell 102. The hood 160 can be coupled along the proximal end of the hand covering 100 as shown. The hood 160 can also be coupled to the shell 102 along the sides 196 and 197 of the outer layer 190 (see FIG. 11). The hood 160 can be included in the seams 138 and 140 along sides 196 and 197. In an alternative embodiment, the hood 160 can be coupled along a portion of the sides 196 and 197 and not to the distal end 192. Such an arrangement allows more of the hood 160 along its sides to be retracted into the receptacle.

As shown, the elongate member 210 has ends 212 and 214. End 212 is disposed within the interior 147 of the binding 142 and the binding 142 is coupled to the shell 102. In other embodiments, the end 212 can be coupled to any location on the distal end of the shell 102. End 214 is coupled to the inner surface 187 of the hood 160. As a user pulls on the elongate member 210 along the direction of arrow C (see FIG. 21), the end 214 of the elongate member 210 and the hood 160 move in the same direction and the hood 160 is drawn into the receptacle 150.

The outer layer 190 includes an opening 199 formed therethrough. Opening 199 can have any size or configuration so long as the elongate member 210 can be inserted through the opening 199. Elongate member 210 can be inserted through opening 199 after the shell 102 is assembled. While opening 199 is illustrated proximate to the proximal end 108 of the hand covering 100, the opening can be located at any location on the outer layer or other part of the shell in alternative embodiments.

Figure 22:
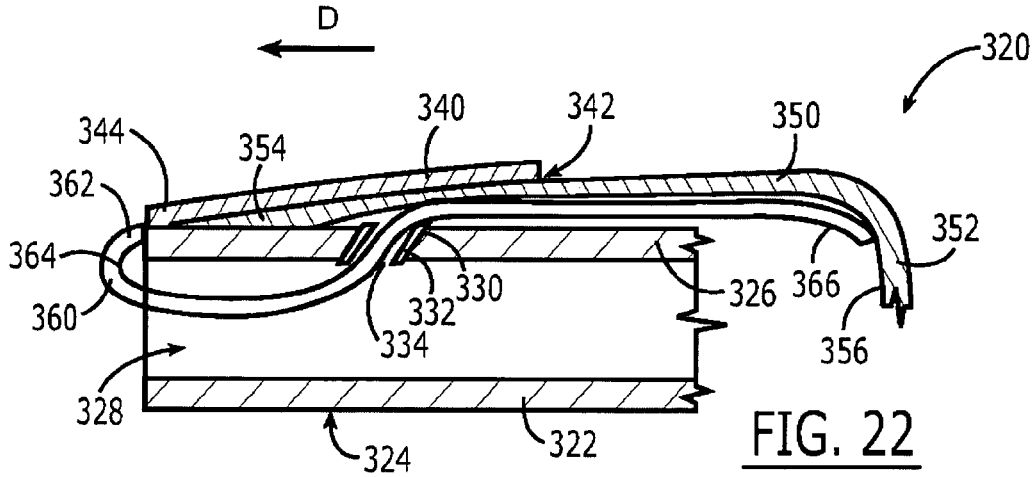
FIG. 22 is a cross-sectional side view of a portion of an alternative embodiment of a hand covering according to the invention.

Referring to FIG. 22, an alternative embodiment of a hand covering according to the invention is illustrated. In this embodiment, the hand covering 320 includes a shell 322 with a palm side portion 324 and a back side portion 326. The shell 322 includes an interior region 328. An outer layer 340 is disposed proximate to the back side portion 324 of the shell 322. The layer 340 and the back side portion 324 form a receptacle 342 therebetween. The outer layer 340 is coupled to the shell 322 at coupling region 344 using any conventional mechanism or technique.

The hand covering 320 includes a hood 350, a portion of which is disposed in the receptacle 342. The hood 350 has a coupling end 354 and a covering portion 352. The coupling end 354 is coupled to the shell 322. The hood 350 has an inner surface 356 that defines the interior region of the hood 350.

The hand covering 320 includes an elongate member 360 that has an end 362 coupled to the shell 322 and an opposite end 366 that is coupled to the inner surface 356 of the hood 350. Disposed between ends 362 and 366 is an actuating portion 364. As a user pulls on the actuating portion 364 along the direction of arrow D, end 366 of the elongate member 360 and the hood 350 are pulled along the same direction.

In this embodiment, the back side portion 326 of the shell 322 includes an opening 330 formed therein. The shell 322 includes an insert 332, such as a grommet, with a passageway 334 disposed in the opening 330. The elongate member 360 is inserted through the opening 330 and the passageway 334 as illustrated in FIG. 22. In this arrangement, a portion of the elongate member 360 is disposed in the interior of the shell 322.

Figure 23:
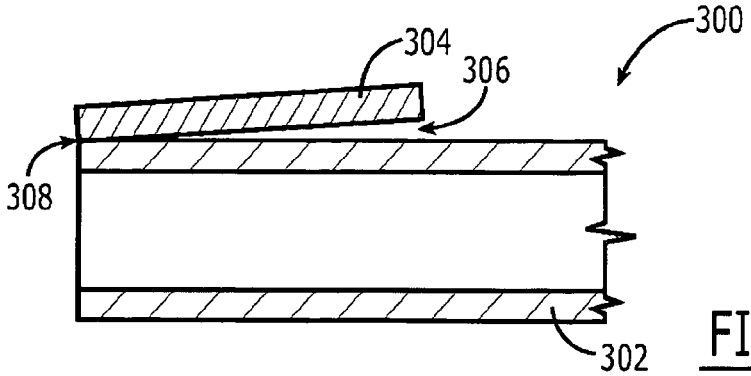
FIG. 23 is a cross-sectional side view of a portion of an alternative embodiment of a hand covering according to the invention.

An alternative embodiment of a hand covering is illustrated in FIG. 23. In particular, a partial cross-sectional view of some of the components of a hand covering 300 is shown. The hand covering 300 includes a shell 302 and an outer layer 304 that define a receptacle 306 therebetween. The outer layer 304 and shell 302 are coupled together at coupling region 308. The coupling can be achieved using any conventional coupling mechanism or technique.

Figure 24:
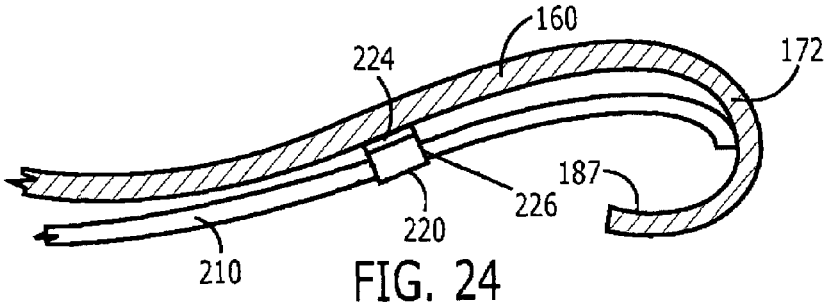
FIG. 24 is a partial cross-sectional side view of the hood of the hand covering illustrated in FIG. 7 taken along line "24-24".

FIG. 24 illustrates a cross-sectional side view of some of the components of a hood and a movement mechanism. In this embodiment, the hood 160 includes a covering portion 172 and an inner surface 187. An elongate member 210 is coupled to the inner surface 187 of the hood 160. A guide 220 is coupled to the inner surface 187 of the hood 160. The guide 220 includes a body or channel portion 226 that defines an opening or passageway therethrough. The guide 220 includes mounting portions 222 and 224 (only one shown in this view) on both sides of the body 226. The mounting portions 222 and 224 are coupled to the inner surface 187 of the hood 160 using any conventional technique or method. The passageway is configured to slidably receive a portion of the elongate member 210.

In one embodiment, multiple guides can be coupled to the inner surface of the hood. In an alternative embodiment, a guide may include a single mounting portion. In other embodiments, the guide can have any configuration, such as a U-shaped configuration, and can be formed from a piece of material that is coupled to the inner surface of the hood.

Referring to FIGS. 25-29, an exemplary process of adjusting a hood is illustrated. In each Figure, only portions of the shell, the hood, and the elongate member are illustrated for simplicity and ease of illustration.

Figure 25:
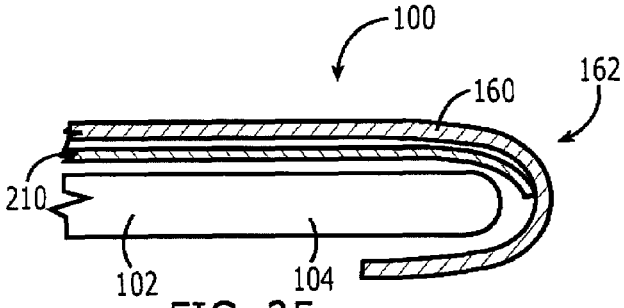
FIGS. 25-29 are partial cross-sectional side views of some of the components of the hand covering illustrated in FIG. 7 in different configurations.

Referring to FIG. 25, the hand covering 100 includes a finger portion 104 and a hood 160. The hood 160 is illustrated in its deployed configuration 162 in which the hood 160 covers part of the finger portion 104. The hand covering 100 also includes an elongate member 210 that is coupled to an inner surface 187 of the hood 160. In this configuration, the user can curl the finger receptacles toward the user's palm close the user's hand and keep the user's fingers warm. When user's fingers are extended and the finger portion 104 straightens as shown in FIG. 25, the palm region of the shell 102 is exposed and not covered.

Figure 26:
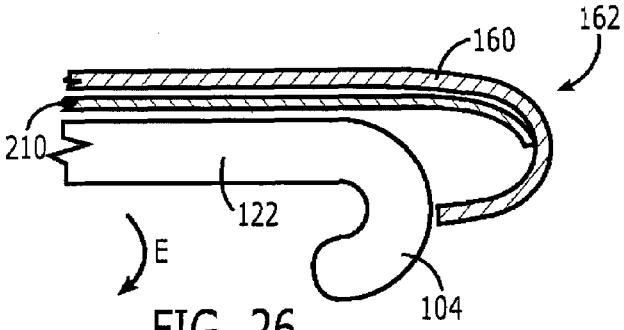

Turning to FIG. 26, the user disengages the finger receptacles 122 from the hood 160 and curls the user's fingers along the direction of arrow E. Such movement removes the finger portion 104 from the hood 160. The hood 160 remains in its deployed configuration 162. One technique to remove the finger receptacles 122 from the hood 160 is to insert the thumb receptacle 120 inside the side portion 178 of the hood 160 and to lift outwardly on the side portion 178. Such movement creates clearance for the removal of the finger portion 104.

Figure 27:
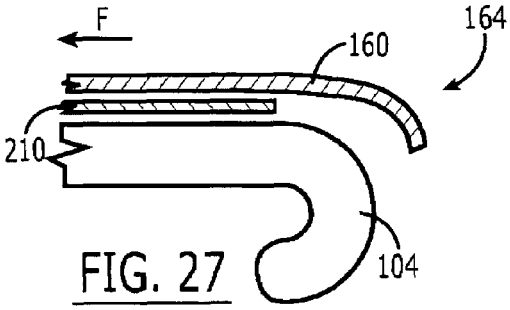

Referring to FIG. 27, the user keeps the finger portion 104 curled and pulls on the elongate member 210 along the direction of arrow F, thereby moving the hood 160 to a partially retracted configuration 164. In an alternative embodiment, the user can pull on the elongate member 210 as the finger portion 104 is extended provided that the finger portion 104 is disengaged from the hood 160.

Figure 28:
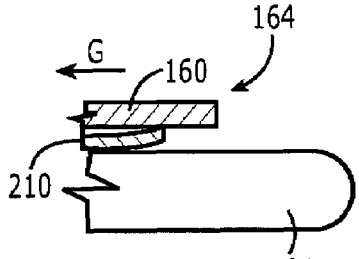

Referring to FIG. 28, the user continues to pull on the elongate member 210 along the direction of arrow G, thereby continuing to move the hood 160 toward the proximal end 108 of the hand covering 100. The user can keep the finger portion 104 in a curled configuration or in an extended configuration.

Figure 29:
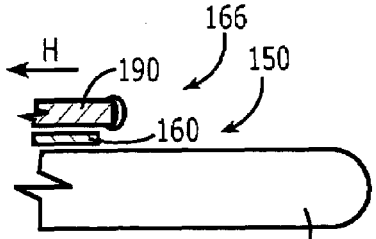

Referring to FIG. 29, the outer layer 190 and the receptacle 150 of the hand covering 100 are illustrated. The elongate member 210 has been pulled so that the hood 160 is in a fully retracted configuration 166 in which the hood 160 is disposed within the receptacle 150. In this configuration, the finger portion 104 is not covered at all by the hood 160. Such configuration allows the user's fingers to be exposed and cooled.

Figure 30:
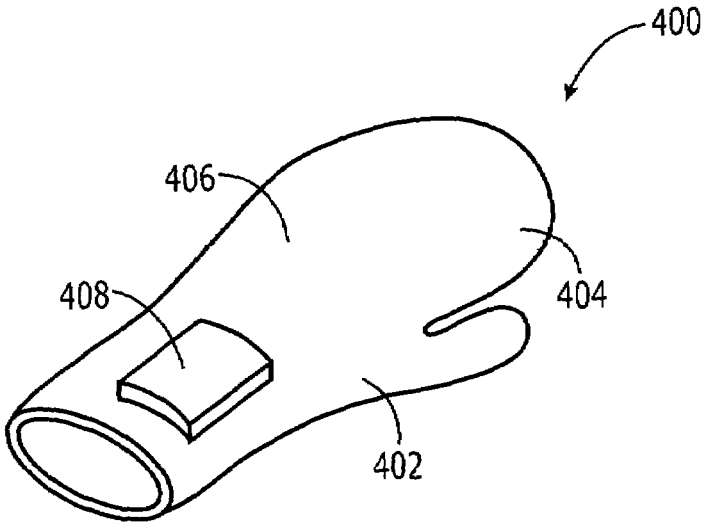
FIGS. 30 and 31 are perspective views of alternative embodiments of a hand covering according to the invention.

An alternative embodiment of a hand covering is illustrated in FIG. 30. Hand covering 400 includes a shell 402 that has a finger portion 404 and an outer surface 406. The finger portion 404 is a single receptacle for the user's fingers, similar to that of a mitten.

Hand covering 400 includes a receptacle 408 disposed on the outer surface 406. In this embodiment, receptacle 408 only extends along a portion of the outer surface 406, which in this example is the back side surface of the shell 402. The receptacle 408 does not extend between the sides of the shell 402 and does not extend to the proximal end of the shell 402. A hood (not shown) can be pulled from the receptacle 408 to a deployed configuration in which it covers the finger portion.404 of the shell 402.

Figure 31:
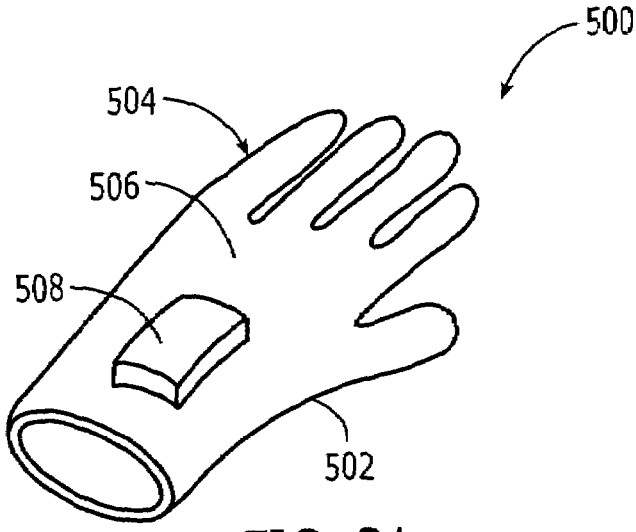

An alternative embodiment of a hand covering is illustrated in FIG. 31. In this embodiment, the hand covering 500 includes a shell 502 with a finger portion 504 with finger receptacles and a thumb receptacle. The shell 502 has an outer surface 506 that has a receptacle 508 coupled thereto. The receptacle 508 does not extend between the sides of the shell 502 and does not extend to the proximal end of the shell 502.

Figure 32:
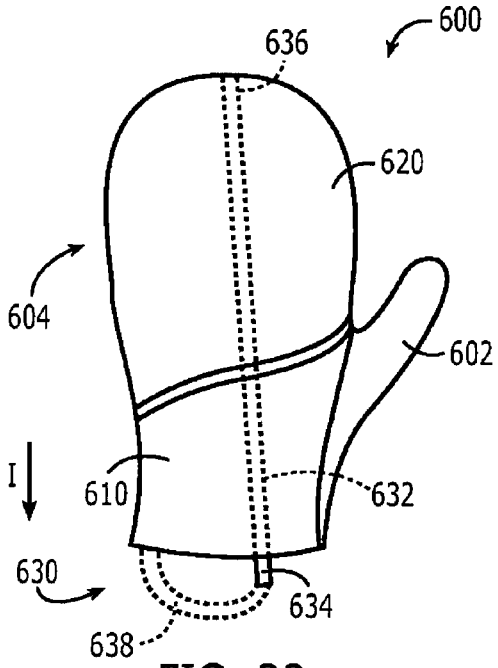
FIGS. 32-35 are plan views of alternative embodiments of a hand covering according to the invention.

An alternative embodiment of a hand covering is illustrated in FIG. 32. In this embodiment, the hand covering 600 includes a shell 602 with a finger portion 604. The hand covering 600 includes an outer layer 610 coupled to the shell 602. The hand covering 600 also includes a hood 620 that is selectively disposable in different configurations in which the hood 620 covers a finger portion 604 of the shell 602 or is retracted into a receptacle formed between the outer layer 610 and the shell 602.

The hand covering 600 has a movement mechanism 630 that includes an elongate member 632 with ends 634 and 636. End 636 is coupled to a portion of the hood 620. In this embodiment, end 634 is not coupled to the shell 602 and extends from the hand covering 600.

The elongate member 632 can be inserted through a portion of the outer layer 610 and/or a portion of the shell 602 of the hand covering 600. When a user pulls on the elongate member 632 along the direction of arrow I, the hood 620 moves from its deployed configuration to a partially or fully retracted configuration. The elongate member 632 can be extended, as shown by extension 638 in dashed lines, and coupled proximate to the proximal end of the shell 602.

Figure 33:
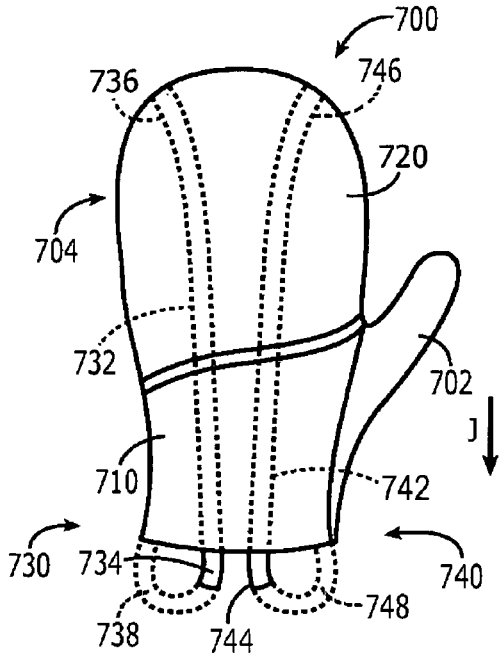

An alternative embodiment of a hand covering is illustrated in FIG. 33. In this embodiment, the hand covering 700 includes a shell 702 that has a finger portion 704. The shell 702 includes an outer layer 710 coupled to the shell 702. The hand covering 700 includes a hood 720 that is selectively disposable in different configurations.

The hand covering 700 includes multiple movement mechanisms 730 and 740 coupled to the hood 720. Movement mechanism 730 includes an elongate member 732 with ends 734 and 736. End 736 is coupled to a portion of the hood 720. In this embodiment, end 734 is not coupled to the shell 702 and extends from the hand covering 700. Movement mechanism 740 includes an elongate member 742 with ends 744 and 746. End 746 is coupled to a portion of the hood 720. In this embodiment, end 744 is not coupled to the shell 702 and extends from the hand covering 700.

The elongate members 732 and 742 can be inserted through a portion of the outer layer 710 and/or a portion of the shell 702 of the hand covering 700. When a user pulls on the elongate member 732 and 742 along the direction of arrow J, the hood 720 is moved from its deployed configuration to a partially or fully retracted configuration.

In an alternative embodiment, either one or both of the ends 734 and 744 of the elongate members 732 and 742 can be coupled to a portion of the shell 702 or layer 710, as shown by extensions 738 and 748, respectively, which are illustrated in dashed lines.

Figure 34:
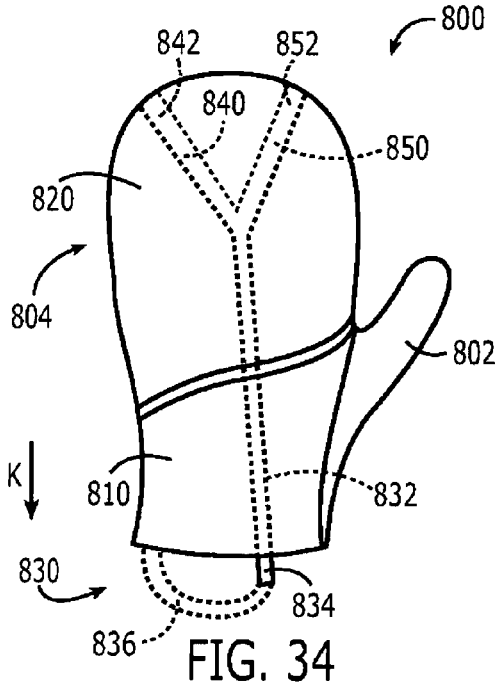

An alternative embodiment of a hand covering is illustrated in FIG. 34. In this embodiment, the hand covering 800 includes a shell 802 with a finger portion 804. The hand covering 800 includes an outer layer 810 coupled to the shell 802. The hand covering 800 includes a hood 820 that is selectively disposable in different configurations.

The hand covering 800 includes a movement mechanism 830 that has an elongate member 832 with an end 834. The elongate member 832 includes a first elongate member portion 840 and a second elongate member portion 850. Portions 840 and 850 are coupled to the hood 820 at ends 842 and 852, respectively.

The elongate member 832 can be inserted through a portion of the outer layer 810 and/or a portion of the shell 802 of the hand covering 800. When a user pulls on the elongate member 832 along the direction of arrow K, the hood 820 is moved from its deployed configuration to a partially or fully retracted configuration. The elongate member 832 can be extended, as shown by extension 836 in dashed lines, and coupled proximate to the proximal end of the shell 802.

Figure 35:
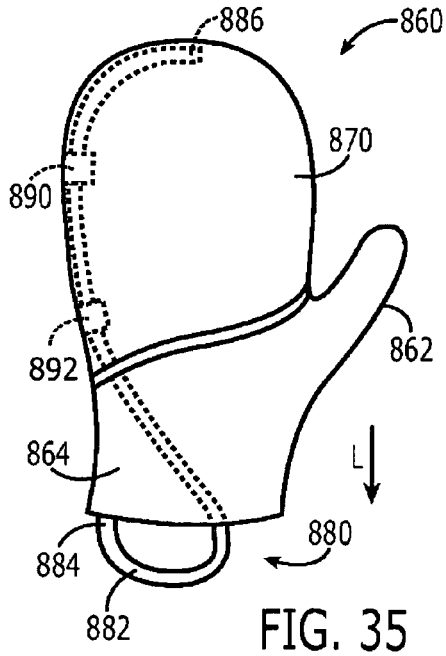

An alternative embodiment of a hand covering is illustrated in FIG. 35. In this embodiment, the hand covering 860 includes a shell 862 and an outer layer 864 coupled to the shell 862. The hand covering 860 includes a hood 870 that is selectively disposable in different configurations.

The hand covering 860 has a movement mechanism 880 that includes an elongate member 882 with ends 884 and 886. End 886 is coupled to a portion of the hood 870 and end 884 is coupled to the shell 862. Several guides 890 and 892 are coupled to an inner surface of the hood 870. Guides 890 and 892 define the path of the elongate member 882.

The elongate member 882 can be inserted through a portion of the outer layer 864 and/or a portion of the shell 862 of the hand covering 860. When a user pulls on the elongate member 882 along the direction of arrow L, the hood 870 moves from its deployed configuration to a partially or fully retracted configuration.

Figure 36:
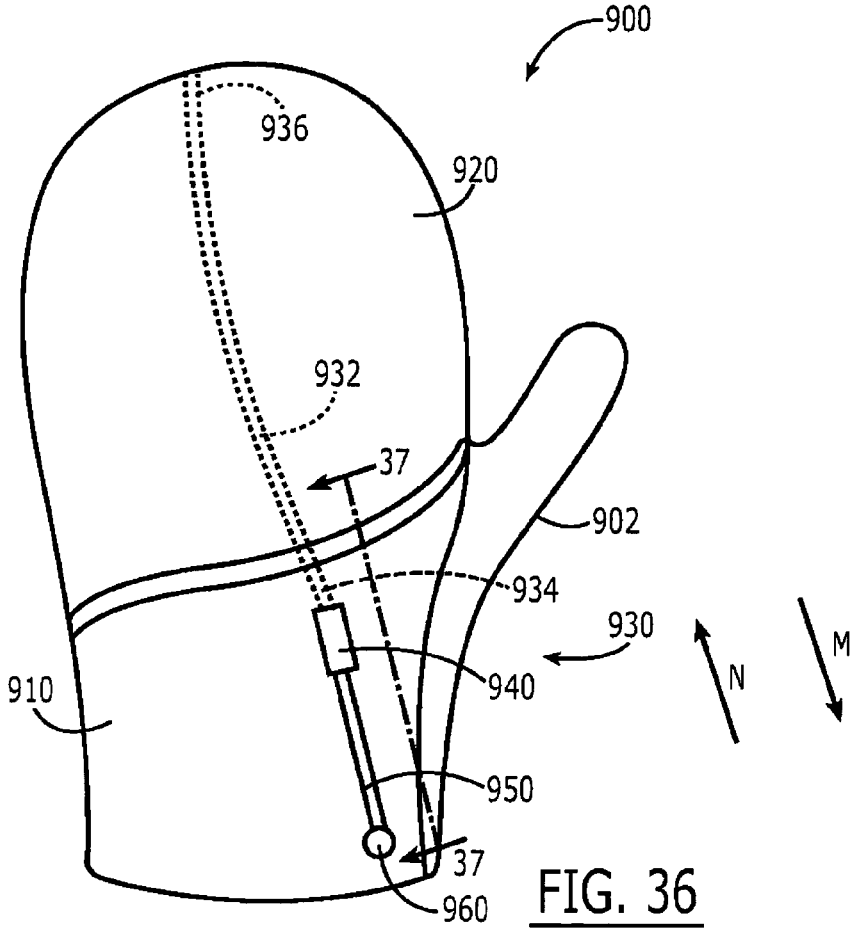
FIG. 36 is a plan view of an alternative embodiment of a hand covering according to the invention.

An alternative embodiment of a hand covering is illustrated in FIG. 36. In this embodiment, the hand covering 900 includes a shell 902 and an outer layer 910 coupled to the shell 902. The hand covering 900 includes a hood 920 that is selectively disposable in different configurations.

The hand covering 900 includes a movement mechanism 930 that has an elongate member 932 with ends 934 and 936. End 936 is coupled to a portion of the hood 920. In this embodiment, end 934 is coupled to a positioner 940 that is movably coupled to a guide 950. Positioner 940 can be any sliding mechanism, such as a non-opening zipper, that can be moved and retained in a particular position relative to the shell 902. The positioner 940 is disposed on the guide 950, such as a zipper track or a rail that is coupled to the hand covering 900. In this embodiment, the positioner 940 and guide 950 are disposed on the outer layer 910. When a user moves or slides the positioner 940 along the direction of arrow M, the elongate member 932 moves in the same direction and the hood 920 moves from the illustrated deployed configuration to a partially or fully retracted configuration.

When the user wants to cover the finger portion of the shell 902 with the hood 920, the user pulls on the hood 920 along the direction of arrow N, thereby moving positioner 940 along guide 950 in the same direction. The elongate member 932 can be inserted through a portion of the layer 910 and/or a portion of the shell 902 of the hand covering 900.

Figure 37:
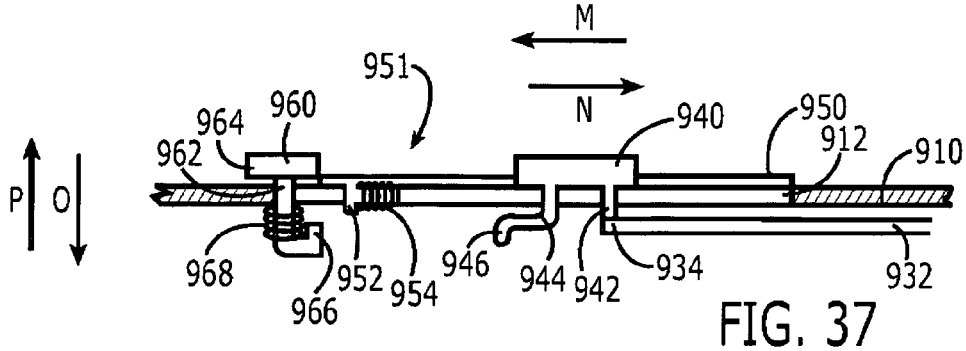
FIG. 37 is a cross-sectional side view of several components of the hand covering illustrated in FIG. 36 taken along line "36-36".

Referring to FIG. 37, a cross-sectional side view of the some of the components of the hand covering 900 is illustrated. The hand covering 900 can include a retaining mechanism or release 960.

As shown in FIG. 37, outer layer 910 includes a slot 912 formed therein that receives a portion of the positioner 940. The positioner 940 includes a coupler 942 and a retainer 944 with a hook portion 946. End 934 of the elongate member 932 is connected to the coupler 942, which can have any size or configuration. The retainer 944 can be located at any location on the positioner 940 provided that it can engage the retaining mechanism 960.

The retaining mechanism 960 includes a body 962 that has an actuator 964, a latch 966 and a biasing mechanism 968, which in one embodiment, is a coil spring. When the positioner 940 is moved along the direction of arrow M, the hook portion 946 on the positioner 940 engages and is retained by the latch 966. When the actuator 964 is moved along the direction of arrow O against the force of the biasing mechanism 968, the latch 966 moves along the same direction and releases the hook portion 946 of the positioner 940. Biasing mechanism 968 provides force along the direction of arrow P to the retaining mechanism 960.

In one embodiment, the hand covering 900 can include a launching mechanism 951. The launching mechanism 951 can be used to move the positioner 940 toward the distal end of the hand covering 900. An exemplary launching mechanism is illustrated in FIG. 37. In this embodiment, the launching mechanism 951 includes an extension 952 and a biasing mechanism 954.

When the actuator 960 is moved along arrow O and the hook portion 946 disengages from the latch 966, the biasing mechanism 954 pushes the positioner 940 along the direction of arrow N. Any movement of the positioner 940, and therefore the elongate member 932 and the hood 920, in the direction of arrow N (which is toward the proximal end of the hand covering 900), moves the hood 920 out of the receptacle and facilitates the moving of the hood 920 by the user to its deployed configuration.

In alternative embodiments, other configurations of launching mechanisms can be used to move the positioner relative to the shell. In alternative embodiments, the positioner and the retaining mechanism of the hand covering can have any size or configuration.

Figure 38:
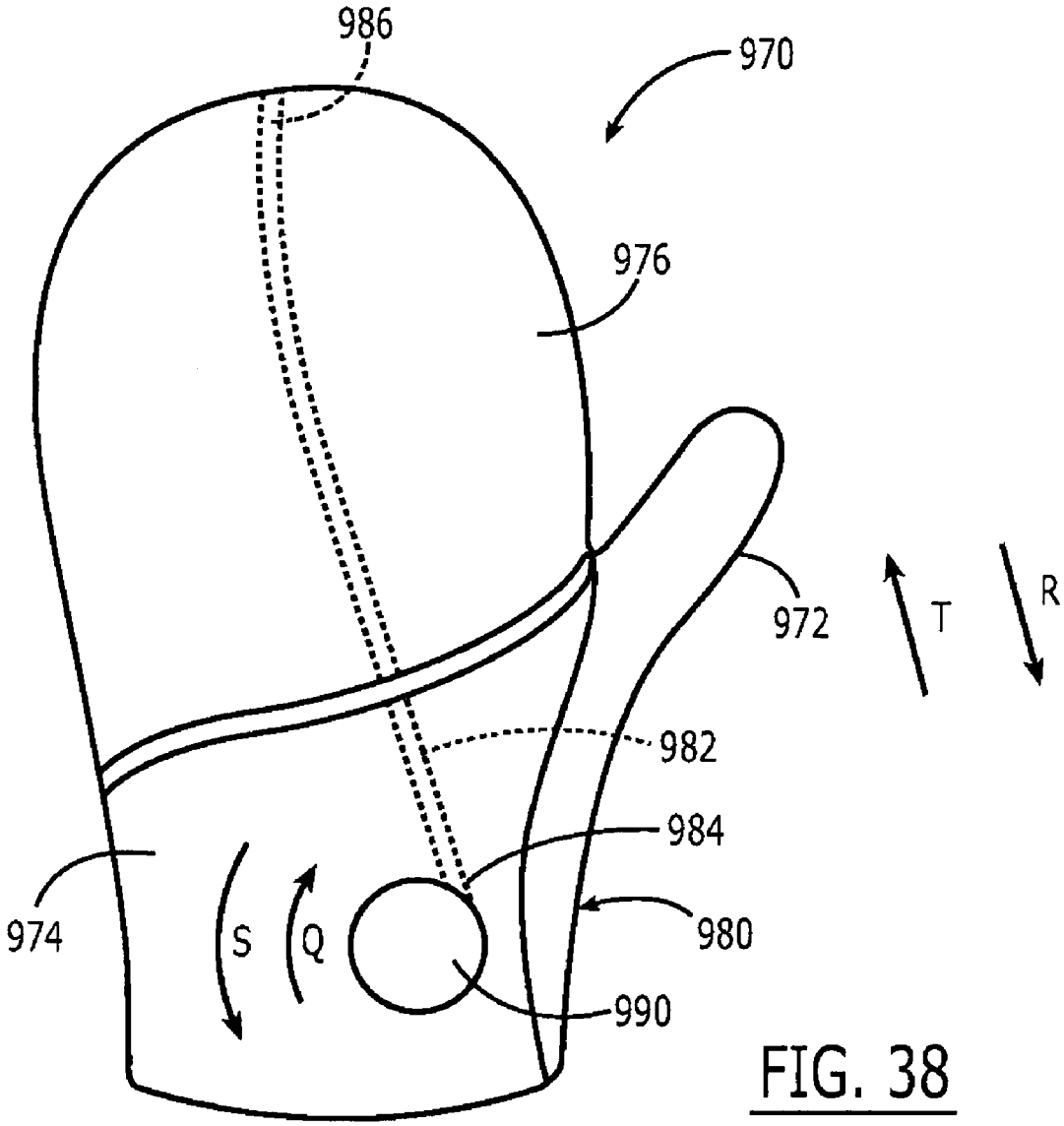
FIG. 38 is a plan view of an alternative embodiment of a hand covering according to the invention.

An alternative embodiment of a hand covering is illustrated in FIG. 38. In this embodiment, the hand covering 970 includes a shell 972 with an outer layer 974 coupled thereto to form a receptacle therebetween. The hand covering 970 includes a hood 976 and a movement mechanism 980 coupled to the hood 976. The movement mechanism 980 includes an elongate member 982 that has ends 984 and 986.

The hand covering 970 includes an actuator 990 that is coupled to the shell 972. End 984 of the elongate member 982 is operably coupled to the actuator 990. End 986 of the elongate member 982 is coupled to the hood 976. Actuator 990 is a mechanism that has a component that can be moved along the direction of arrow Q to pull on the end 984 and move the elongate member 982 along the direction of arrow R to retract the hood 976. For example, the actuator 990 can be a rotating wheel, pulley or disk, or a ratchet mechanism with teeth. The moving component or components of the actuator 990 can be moved along the direction of arrow S to enable the elongate member 982 to be moved along the direction of arrow T.

Figure 39:
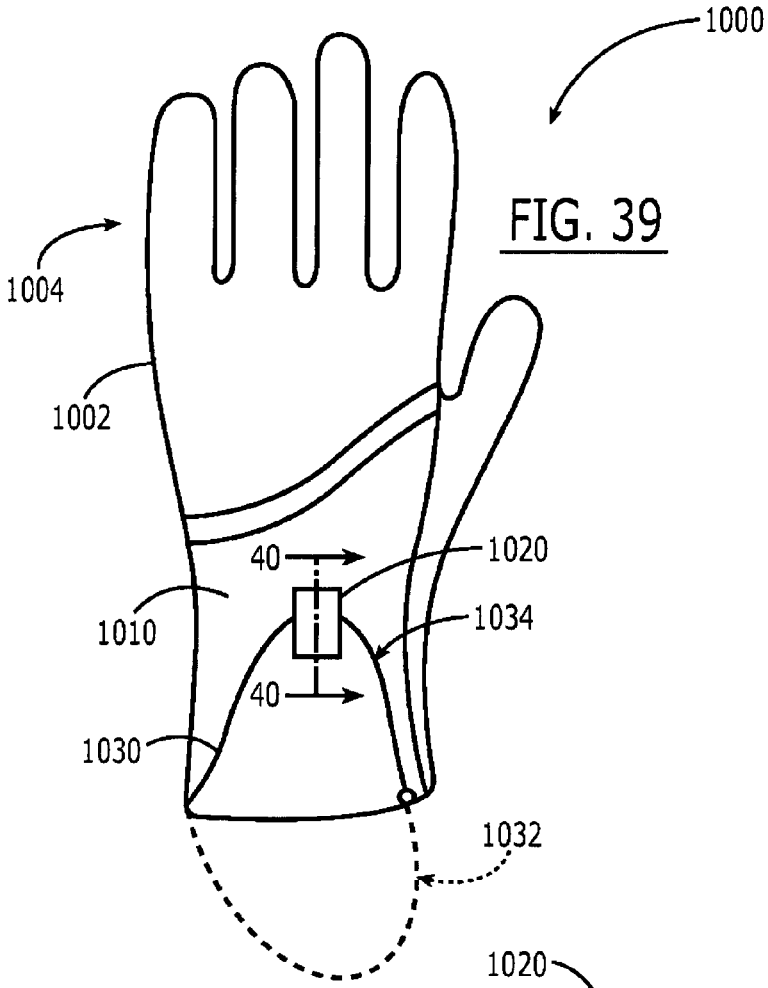
FIG. 39 is a plan view of an alternative embodiment of a hand covering according to the invention.
Figure 40:
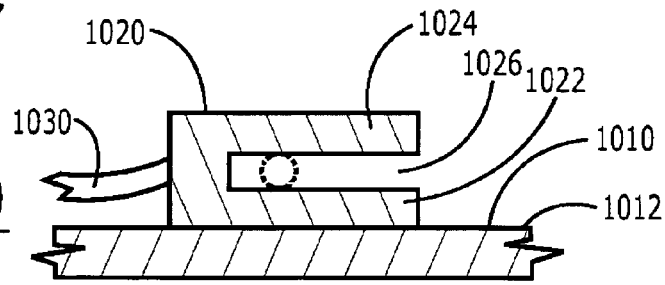
FIG. 40 is a cross-sectional side view of several components of the hand covering illustrated in FIG. 39 taken along line "40-40".
Figure 41:
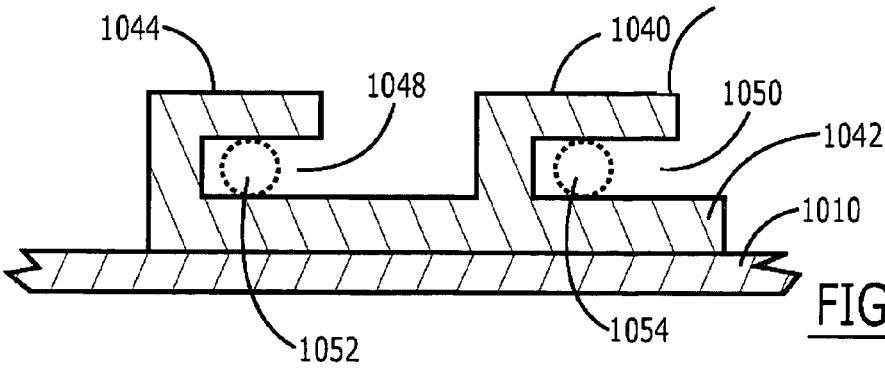
FIG. 41 is a cross-sectional side view of several components of an alternative embodiment of a hand covering according to the invention.

An alternative embodiment of a hand covering is illustrated in FIGS. 39-41. Referring to FIG. 39, the hand covering 1000 includes a shell 1002 with a finger portion 1004. Coupled to the shell 1002 is an outer layer 1010 that forms a receptacle with the outer surface of the shell 1002. The layer 1010 includes an outer surface 1012 (see FIG. 40).

The hand covering 1000 includes an elongate member 1030 that is coupled to the shell 1002 and a hood, which is not shown and in this configuration is disposed in the receptacle of the hand covering 1000. The elongate member 1030 is inserted through an opening in the outer layer 1010 and/or the shell 1002 and is coupled to the hood. The elongate member 1030 can be disposed in multiple positions 1032 and 1034.

The hand covering 1000 includes a coupler or retainer 1020. In one embodiment, the retainer 1020 is coupled to the outer surface 1012 of the outer layer 1010. Referring to FIG. 40, a cross-sectional side view of the retainer 1020 is illustrated. Retainer 1020 includes a base 1022 with an outer portion 1024 and an opening or channel 1026. The channel 1026 is configured to receive a portion of the elongate member 1030.

After the elongate member 1030 is pulled to retract the hood into the receptacle, the elongate member 1030 is in its extended position 1032. The elongate member 1030 can be moved to a retained position 1034 in which it engages the retainer 1020. In this position 1034, the elongate member 1030 does not flop or move around while the user wears the hand covering 1000.

An alternative embodiment of a retainer is illustrated in FIG. 41. A cross-sectional side view of some components of a hand covering, particularly the retainer, is shown. The retainer 1040 includes a base 1042 with coupling portions 1044 and 1046 that define openings or channels 1048 and 1050. The elongate member can be disposed in opening 1048 (see deployed position 1052) when the hood is in its deployed configuration which increases the amount of the elongate member that extends from the hand covering. The elongate member can be disposed in opening 1050 (see retracted position 1054) when the hood is in a retracted configuration which increases the amount of the elongate member that extends from the hand covering causing the elongate member to extend closer to the distal end of the hand covering.

Figure 42:
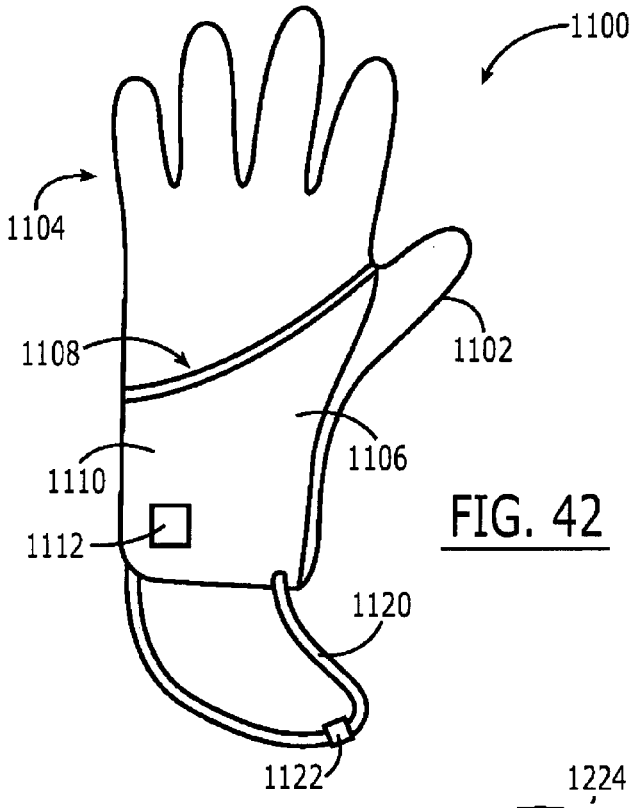
FIGS. 42-43 are plan views of alternative embodiments of a hand covering according to the invention.

An alternative embodiment of a hand covering is illustrated in FIG. 42. In this embodiment, the hand covering 1100 includes a shell 1102 with a finger portion 1104. The hand covering 1100 includes an outer layer 1106 that forms a receptacle 1108 with the back portion of the shell 1102. The outer layer 1106 includes an outer surface 1110.

The hand covering 1100 includes a coupler 1112 attached thereto. In FIG. 42, coupler 1112 is attached to the outer surface 1110 of outer layer 1106. In alternative embodiments, the coupler 1112 can be attached to any component of the hand covering 1100 at any location.

The hand covering 1100 includes an elongate member 1120 that is coupled to a hood, which in this configuration is located in the receptacle 1108 and is not shown. To reduce the movement of the elongate member 1120 during use of the hand covering 1100, the elongate member 1120 can include a coupler 1122. Coupler 1122 can be formed separately from and mounted to the elongate member 1120. Alternatively, coupler 1122 can be integrally formed with the elongate member 1120.

Couplers 1112 and 1122 cooperate with each other to retain the elongate member 1120 in a particular position relative to the remainder of the hand covering 1100. Couplers 1112 and 1122 can be any type of coupler or fastener that removably couples the elongate member 1120 to the shell 1102. In one embodiment, couplers 1112 and 1122 can be mating hook and loop fasteners. In another embodiment, couplers 1112 and 1122 can be magnets. In another embodiment, couplers 1112 and 1122 can be cooperating clips, hooks or other retaining devices. In an alternative embodiment, couplers can be provided on the hand covering and on the elongate member even if the elongate member is coupled only to the hood.

Figure 43:
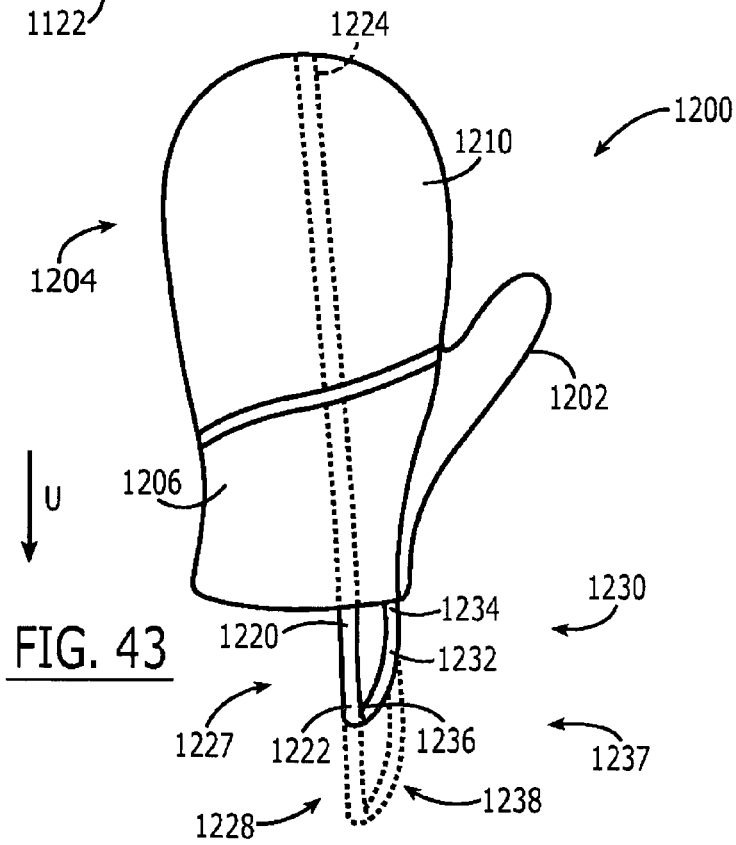

An alternative embodiment of a hand covering is illustrated in FIG. 43. In this embodiment, the hand covering 1200 includes a shell 1202 with a finger portion 1204. The hand covering 1200 includes an outer layer 1206 that forms a receptacle with the back portion of the shell 1202. The hand covering 1200 also includes a hood 1210 that is selectively disposable in different configurations.

The hand covering 1200 has a movement mechanism that includes an elongate member 1220 with ends 1222 and 1224. End 1224 is coupled to the hood 1210. End 1222 can extend from the shell 1202 as shown, or alternatively, can be coupled to the shell 1202.

In this embodiment, the hand covering 1200 has a suspension mechanism 1230 that includes an elastic member 1232. The elastic member 1232 has ends 1234 and 1236 and elastic properties so that it can be stretched and return to its original configuration. For example, the elastic member 1232 can be a "bungee" like cord. End 1234 of the elastic member 1232 is coupled to the shell 1202. End 1236 of the elastic member 1232 is coupled to the elongate member 1220. The elastic member 1232 has greater elastic properties than the elongate member 1220 and therefore imparts movement to the elongate member 1220 when released.

When the user pulls on the elongate member 1220 along the direction of arrow U, the elongate member 1220 moves to an extended position 1228 and the elastic member 1232 moves to an extended position 1238. When the user releases the elongate member 1220, the elastic member 1232 retracts to a retracted position 1237, thereby moving the elongate member 1220 closer to the shell 1202 to a retracted position 1227.

The extent to which the elastic member 1232 retracts and thereby pulls the elongate member 1220 closer to the shell 1202 is determined by the length of the elastic member 1232 and the location at which the elastic member 1232 is coupled to the shell 1202. In one embodiment, the elastic member 1232 is coupled to either the outer layer 1206 or back side portion of the shell 1202. The elastic member 1232 can be sized or configured such that in its retracted or unbiased configuration, end 1236 is disposed proximate to the proximal end of the hand covering 1200. In another embodiment, the elastic member can be coupled to an outer surface on the hand covering.

Figure 44:
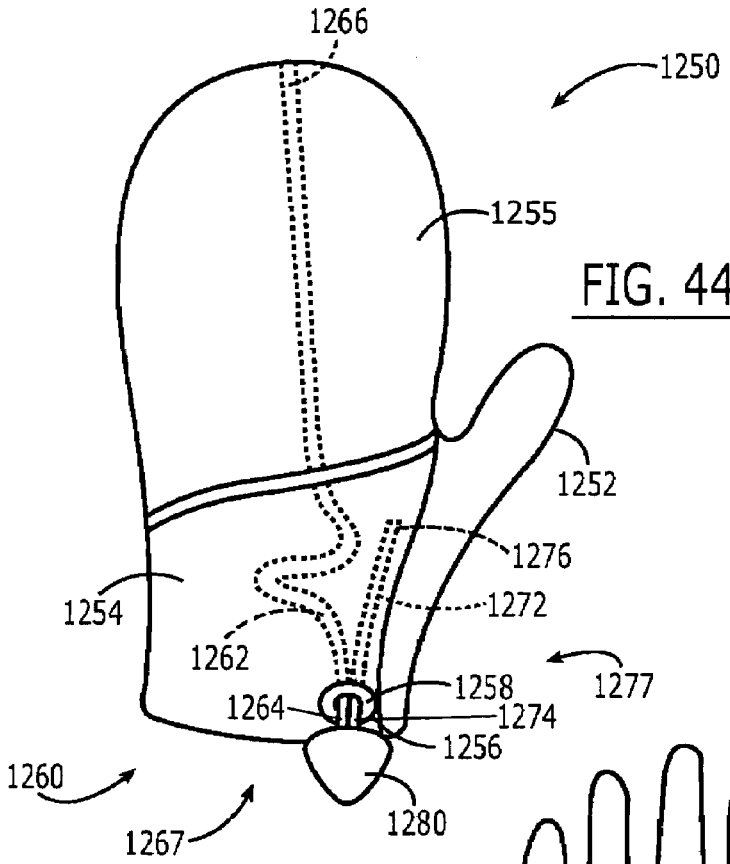
FIGS. 44-45 are plan views of an alternative embodiment of a hand covering in different configurations.
Figure 45:
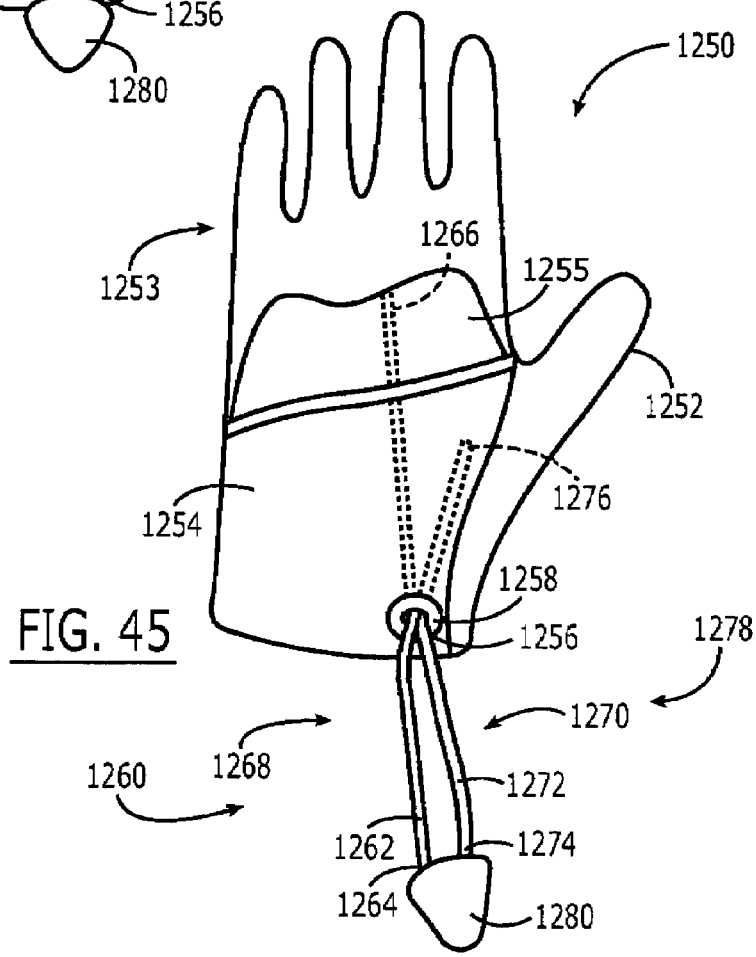

An alternative embodiment of a hand covering is illustrated in FIGS. 44-45. In this embodiment, the hand covering 1250 includes a shell 1252 with a finger portion 1253 (see FIG. 45). The hand covering 1250 includes an outer layer 1254 that forms a receptacle with the back portion of the shell 1252. The outer layer 1254 includes an opening in which an insert 1256, such as a grommet, is disposed. The grommet 1256 can have any size or configuration and includes an opening 1258 that allows the insertion and passage of members identified below. The hand covering 1250 also includes a hood 1255 that is selectively disposable in different configurations.

The hand covering 1250 has a movement mechanism 1260 that includes an elongate member 1262 with ends 1264 and 1266. End 1266 is coupled to the hood 1255 and end 1264 is coupled to a pull tab 1280.

The hand covering 1250 has a suspension mechanism 1270 that includes an elastic member 1272. The elastic member 1272 has ends 1274 and 1276 and elastic properties so that it can be stretched and return to its original configuration. End 1276 of the elastic member 1272 is coupled to the shell 1252 and end 1274 is coupled to the pull tab 1280. In one embodiment, the end 1276 is coupled to the inner surface of layer 1254 or another part of the shell.

FIG. 44 illustrates the elongate member 1262 in a retracted position 1267 that corresponds with the hood 1255 being in its deployed configuration. After the user has released the pull tab 1280, the elastic member 1272 retracts to its unbiased position 1277, which causes the pull tab 1280 to be moved proximate to the grommet 1256. In these positions, the amounts of the elongate member 1262 and the elastic member 1272 that extend outwardly from the hand covering 1250 are reduced.

FIG. 45 illustrates the elongate member 1262 in an extended position 1268 which corresponds to the position to which a user is pulling on the elongate member 1262 via the pull tab 1280. When the user pulls on the pull tab 1280, the elastic member 1272 is stretched to its extended position 1278 as shown. When the user releases the pull tab 1280, the elongate member 1262 and the elastic member 1272 return to their retracted positions 1267 and 1277, respectively, as illustrated in FIG. 44. The extent to which the elastic member 1272 retracts and pulls the end 1264 of the elongate member 1262 toward the shell 1252 is determined by the length of the elastic member 1272 and the location at which the elastic member 1272 is coupled to the shell 1252.

Figure 46:
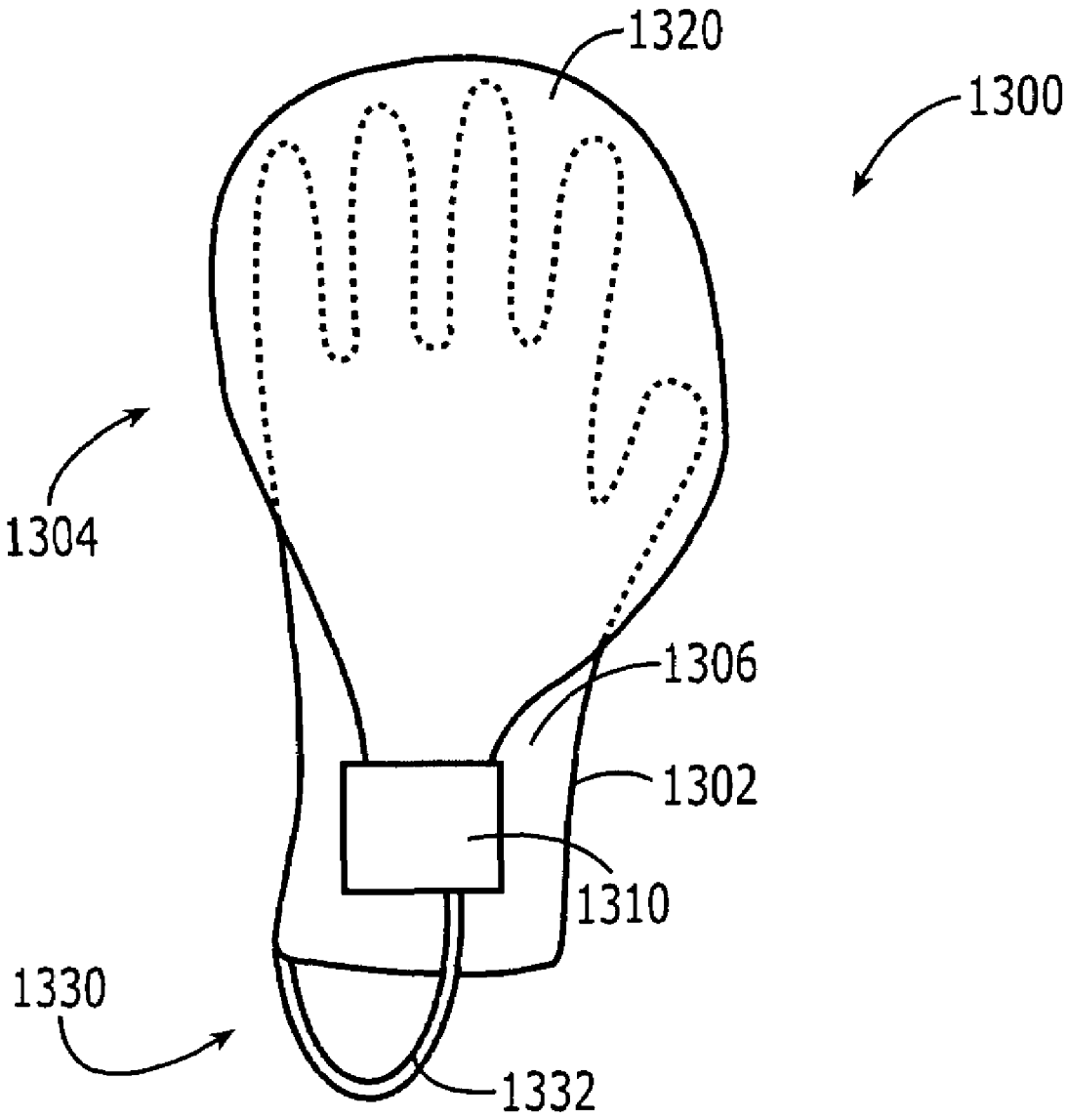
FIG. 46 is a plan view of an alternative embodiment of a hand covering according to the invention.

An alternative embodiment of a hand covering is illustrated in FIG. 46. In this embodiment, the hand covering 1300 includes a shell 1302 with a finger portion 1304 and an outer surface 1306. The hand covering 1300 includes a receptacle 1310 coupled to the shell 1302. In one embodiment, the receptacle 1310 is coupled to the outer surface 1306.

The hand covering 1300 includes a hood 1320 that is selectively disposable relative to the shell 1302. The hand covering 1300 includes a movement mechanism 1330 that has an elongate member 1332 that is coupled to the hood 1320. In this embodiment, the hood 1320 is configured to cover the finger receptacles and the thumb receptacle of the shell 1302.

Figure 47:
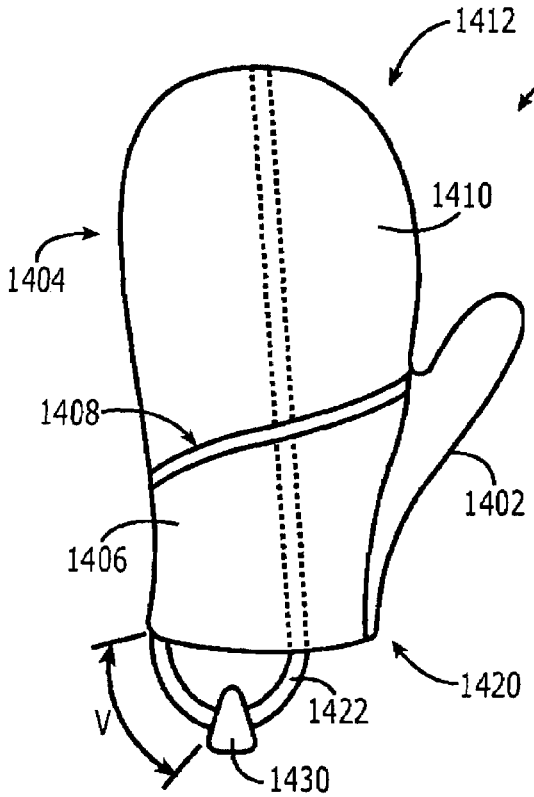
FIGS. 47-48 are plan views of an alternative embodiment of a hand covering according to the invention.
Figure 49:
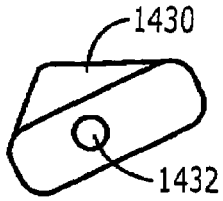
FIG. 49 is a perspective view of the pull guide of the hand covering illustrated in FIGS. 47-48.
Figure 48:
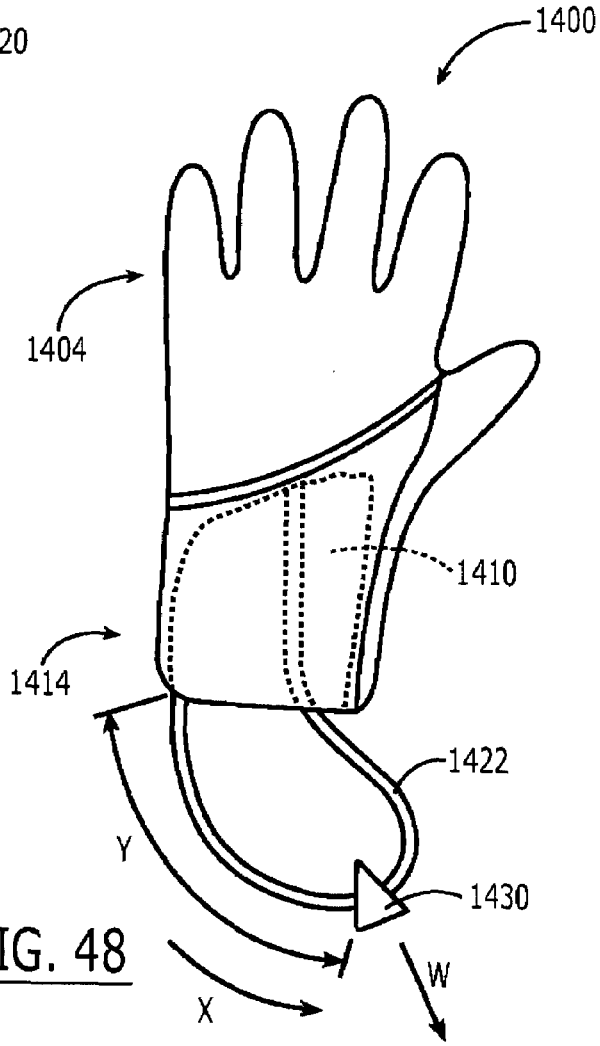

An alternative embodiment of a hand covering is illustrated in FIGS. 47-49. In this embodiment, the hand covering 1400 includes a shell 1402 with a finger portion 1404 and an outer layer 1406. The outer layer 1406 is coupled to a portion of the shell 1402 and forms a receptacle 1408.

The hand covering 1400 includes a hood 1410 that is selectively disposable in different configurations. For example, the hood 1410 can be disposed in a deployed configuration 1412 (see FIG. 47) and in a retracted configuration 1414 (see FIG. 48).

The hand covering 1400 includes a movement mechanism 1420 that has an elongate member 1422 that can be manipulated by the user to move the hood 1410. In this embodiment, a pull guide 1430 is provided on the elongate member 1422.

An embodiment of the pull guide is illustrated in FIG. 49. Pull guide 1430 includes a body portion with an opening or passageway 1432 therethrough. The passageway 1432 is configured to slide along the elongate member 1422. Referring to FIG. 47, the pull guide 1430 is shown in a first position along elongate member 1422 that is a distance V from the shell 1402. When the user pulls on the pull guide 1430 along the direction of arrow W (see FIG. 48) to retract the hood 1410, the pull guide 1430 moves along the elongate member 1422 along the direction X. As the user pulls, the pull guide 1430 moves to a distance Y from the shell 1402. As the user pulls on the pull guide 1430, the movement of the pull guide 1430 facilitates the retraction of the hood 1410. As the user pulls on the pull guide 1430, the pull guide 1430 remains approximately at the mid-point of the length of the elongate member 1422 that is disposed outside of the shell 1402.

Figure 50:
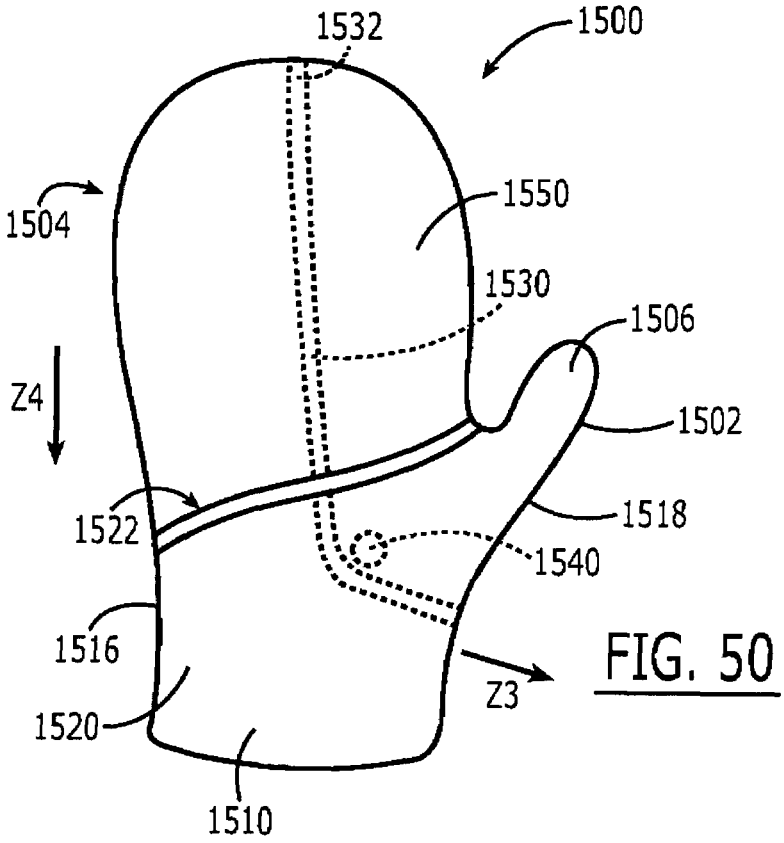
FIG. 50 is a plan view of an alternative embodiment of a hand covering according to the invention.
Figure 51:
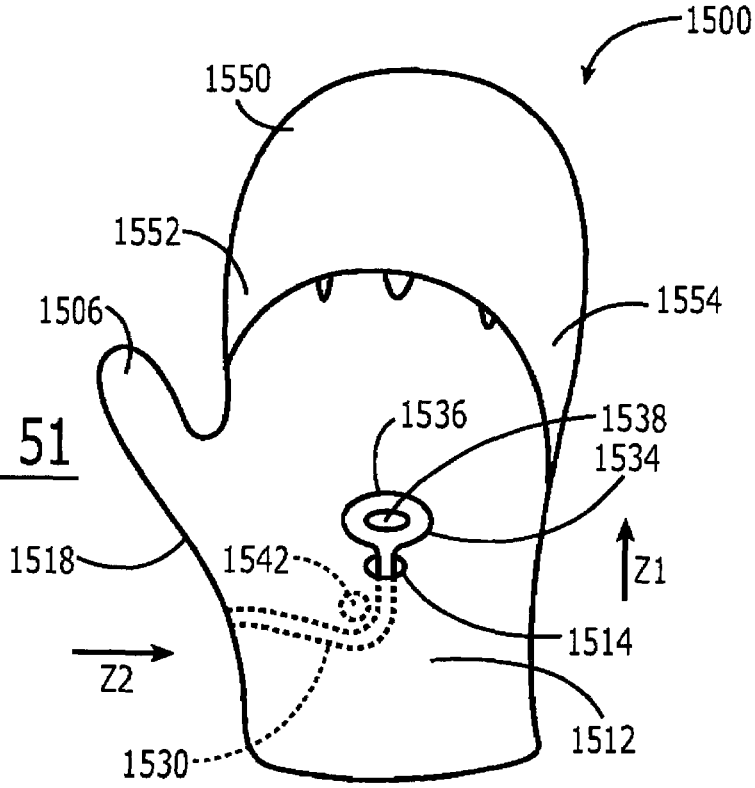
FIG. 51 is a bottom view of the hand covering illustrated in FIG. 50.

An alternative embodiment of a hand covering according to the invention is illustrated in FIGS. 50 and 51. In this embodiment, the hand covering 1500 includes a shell 1502 with a finger portion 1504 and a thumb receptacle 1506. The shell 1502 includes a back side portion 1510 and a palm side portion 1512. In this embodiment, the palm side surface 1512 includes an opening 1514 formed therein. The size and location of the opening 1514 can vary provided that the opening 1514 is on the palm side portion 1512. The shell 1502 also includes side portions 1516 and 1518.

The hand covering 1500 includes an outer layer 1520 that forms a receptacle 1522 with a portion of the shell 1502. The hand covering 1500 includes an elongate member 1530 that has ends 1532 and 1534 and an actuating portion 1536 proximate to end 1534. The actuating portion 1536 includes an opening 1538 formed therein that is configured to receive a portion of a finger or thumb receptacle to allow the user to pull on the elongate member 1530. The hand covering 1500 also includes a hood 1550 that has side portions 1552 and 1554. A portion of the hood 1550 is disposed in the receptacle 1522. End 1532 of the elongate member 1530 is coupled to the hood 1550.

The hand covering 1500 includes guides 1540 and 1542 that are disposed on the shell 1502 and that direct the elongate member 1530 around the hand covering 1500. As illustrated in FIGS. 50 and 51, the elongate member 1530 extends from the distal tip of the back side portion around the thumb receptacle 1506 and exits the shell on the palm side portion.

To retract the hood 1550, the user inserts the thumb receptacle 1506 inside of side portion 1552 and disengages the finger portion of the shell 1502 from the hood 1550. The user can insert one of the finger or thumb receptacles into the opening 1538 formed in the elongate member 1530 and pull the actuating portion 1536 of the elongate member 1530 along the direction of arrow Z1. Such movement causes the elongate member to move along the directions of arrows Z2, Z3 and Z4, thereby pulling the hood into the receptacle 1522.

The opening 1538 can be configured so that a user can slip the actuating portion 1536 off of the finger or thumb receptacle after the hood 1550 has been retracted into the receptacle 1522. A coupler (not shown) can be provided on one or both of the shell and the elongate member to couple the elongate member to the shell and reduce the relative movement of the two elements.

Figure 52:
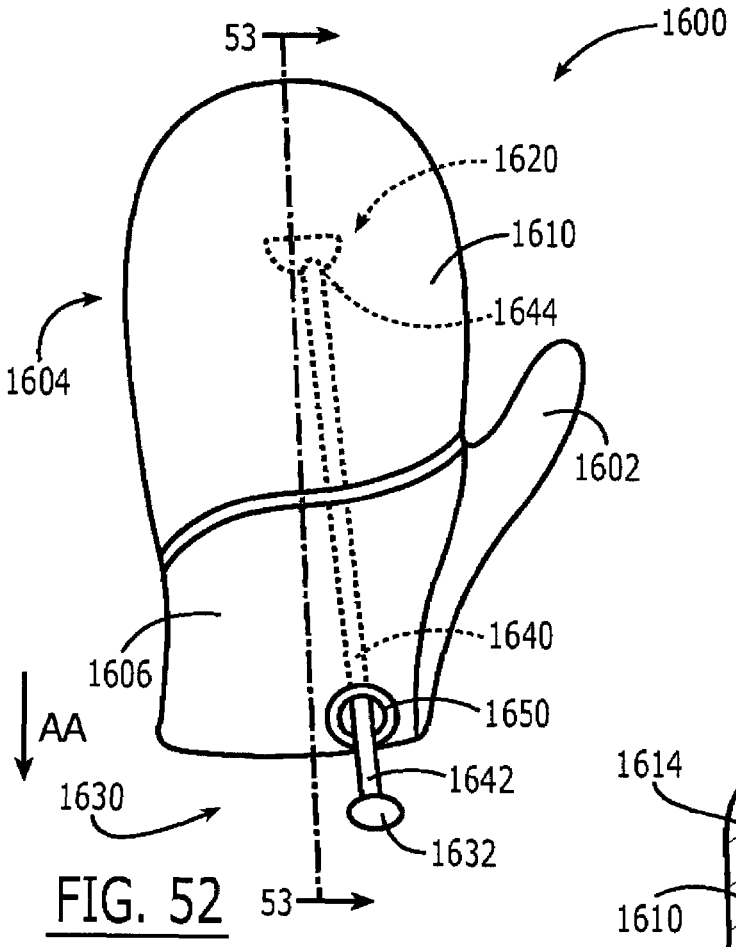
FIG. 52 is a plan view of an alternative embodiment of a hand covering according to the invention.
Figure 53:
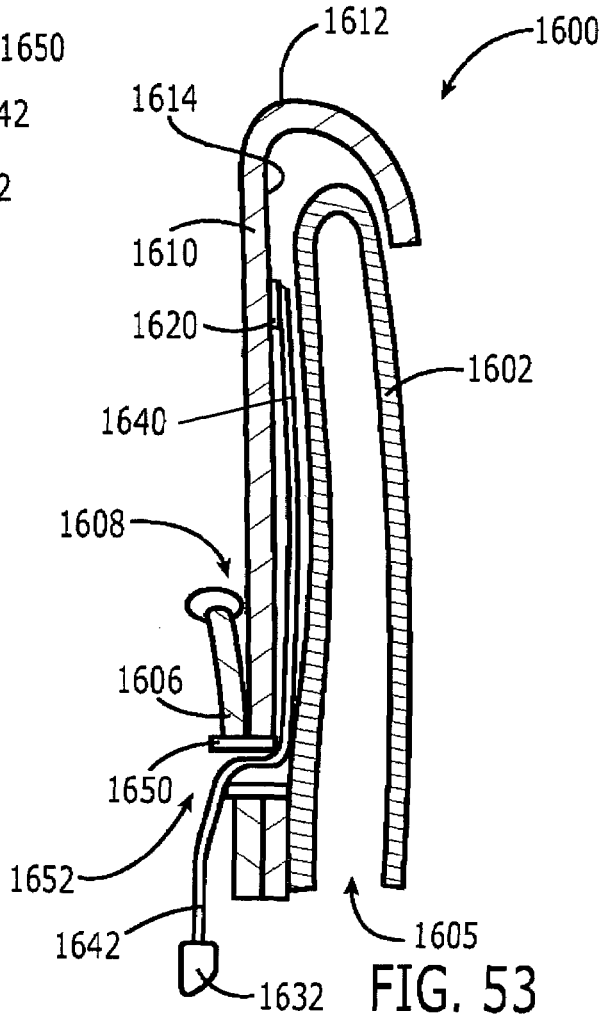
FIG. 53 is a cross-sectional side view of the hand covering illustrated in FIG. 52 taken along line "53-53".
Figure 54:
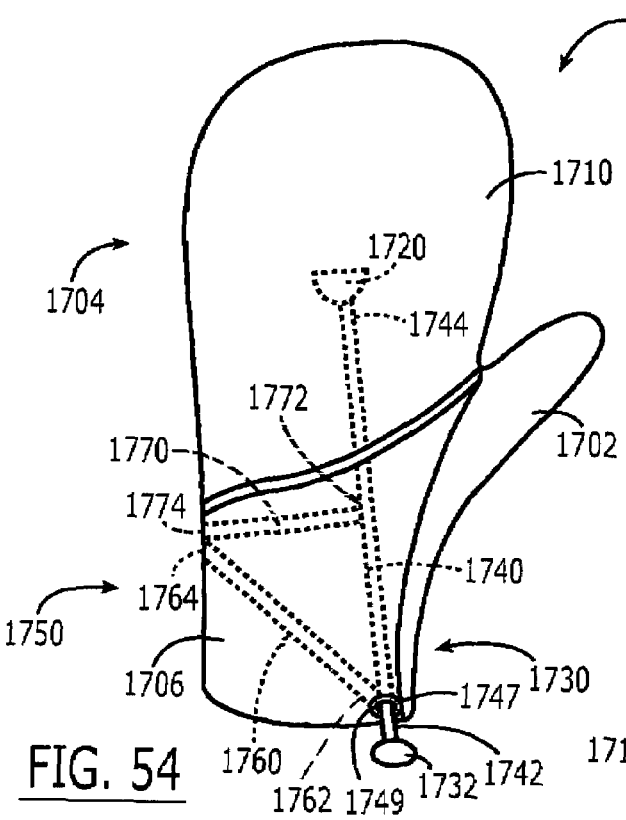
FIG. 54 is a plan view of an alternative embodiment of a hand covering in a first configuration according to the invention.
Figure 55:
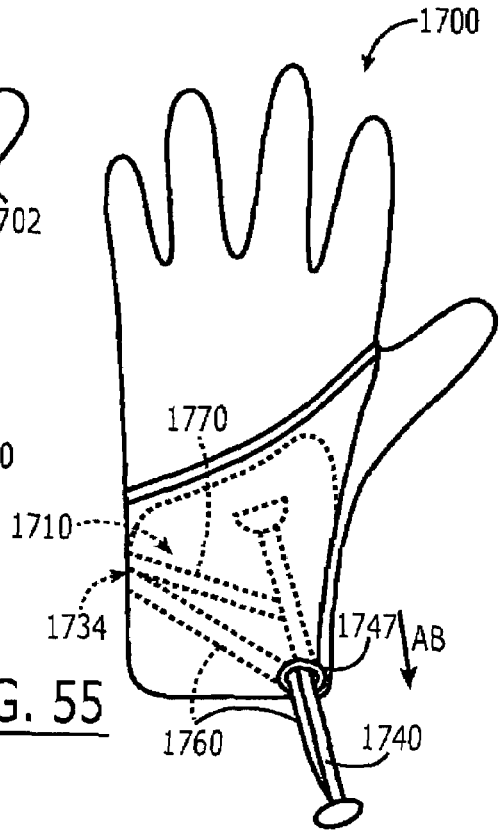
FIG. 55 is a plan view of the hand covering illustrated in FIG. 54 in a second configuration.

An alternative embodiment of a hand covering is illustrated in FIGS. 52 and 53. In this embodiment, the hand covering 1600 includes a shell 1602 with a finger portion 1604 and an interior region 1605 (see FIG. 53). The hand covering 1600 includes an outer layer 1606 that is coupled to the shell 1602. The outer layer 1606 and the shell 1602 define a receptacle 1608 therebetween (see FIG. 53). The hand covering 1600 also includes a hood 1610 that is selectively disposable in different configurations. The hood has an outer surface 1612 and an inner surface 1614.

The hand covering 1600 includes a movement mechanism 1630 that has an elongate member 1640 with ends 1642 and 1644. The elongate member 1640 extends outwardly from the hand covering 1600 so a user can grasp the end 1642 of the elongate member 1640 and pull it along the direction of arrow AA.

In this embodiment, the hand covering 1600 includes a grommet 1650 that is inserted through and coupled to the outer layer 1606 and the hood 1610. The grommet 1650 has an opening 1652 through which the elongate member 1640 is inserted. In alternative embodiments, the elongate member 1640 can be inserted through any portion of the hand covering 1600 as previously described.

A tether or tab 1632 is coupled to end 1642 of the elongate member 1640. Tab 1632 provides a larger gripping area for the user to pull the elongate member 1640. As illustrated in FIG. 52, the other end 1644 of the elongate member 1640 is connected to a coupler 1620. Coupler 1620 can be any type of material, such as a fabric. Coupler 1620 is coupled to the inner surface 1614 of the hood 1610 using any conventional technique, including sewing or an adhesive. In alternative embodiments, coupler can have any shape or configuration.

Referring to FIG. 53, several components of the hand covering 1600 are illustrated. Coupler 1620 is coupled to the inner surface 1614 of the hood 1610. In this embodiment, coupler 1620 is coupled to the hood 1610 at a location that is spaced inwardly from the perimeter of the hand covering 1600. Disposing the coupler 1620 toward the proximal end of the hand covering 1600 shortens the length that the elongate member 1640 must be to pull the hood 1610 into the receptacle 1608.

An alternative embodiment of a hand covering is illustrated in FIGS. 54-57. In this embodiment, the hand covering 1700 includes a shell 1702 with a finger portion 1704. The hand covering 1700 includes an outer layer 1706 that is coupled to the shell 1702. The hand covering 1700 includes a hood 1710 that is selectively disposable in different configurations.

In this embodiment, the hand covering 1700 includes a coupler 1720 that is coupled to the hood 1710. In alternative embodiments, the hand covering 1700 does not include a coupler 1720.

The hand covering 1700 includes a movement mechanism 1730. The movement mechanism 1730 includes an elongate member 1740 with ends 1742 and 1744 and a tab 1732 coupled to end 1742. Elongate member 1740 can be made of a relatively non-elastic material. In this embodiment, the hand covering 1700 includes a grommet 1747 that is inserted through the outer layer 1706. Grommet 1747 includes an opening 1749 through which the elongate member 1740 is inserted.

In this embodiment, the hand covering 1700 has a suspension mechanism 1750 that includes elastic members 1760 and 1770. The elastic members 1760 and 1770 are disposed in the receptacle formed by the outer layer 1706 and the shell 1702 and are illustrated in dashed lines in FIGS. 54 and 55.

Each of the elastic members 1760 and 1770 is coupled at one of its ends to the elongate member 1740 and at its other end to the hand covering 1700. When the elongate member 1740 is pulled outwardly along the direction of arrow AB in FIG. 55 to move the hood 1700 from a deployed configuration to a retracted configuration, the elastic members 1760 and 1770 are stretched. When the elongate member 1740 is pulled outwardly, a portion of the elastic member 1760 is also pulled outwardly through the grommet 1747. When a user releases the elongate member 1740, the elastic members 1760 and 1770 return to their unbiased or retracted configurations (shown in FIG. 56). Such movements cause all or substantially all of the elongate member 1740 to be pulled into the hand covering 1700.

Elastic member 1760 has ends 1762 and 1764 and elastic properties so that it can be stretched and return to its original configuration. For example, the elastic member 1760 can be a "bungee"-like cord. End 1762 is coupled to the elongate member 1740 using any conventional technique, including sewing, an adhesive, welding, molding, weaving, etc. End 1764 is coupled to the shell 1702 of the hand covering 1700 using any conventional technique. In this embodiment, end 1764 is coupled proximate to a coupling region 1734 which is spaced apart from the elongate member 1740. Coupling region 1734 is disposed proximate to a side of the hand covering 1700. In an alternative embodiment, the elastic member 1760 can be formed integrally with elongate member 1740. Also, coupling region can be disposed at any location on the hand covering 1700.

Elastic member 1770 has ends 1772 and 1774 and elastic properties so that it can be stretched and return to its original configuration. For example, the elastic member 1770 can be a "bungee"-like cord. End 1772 is coupled to the elongate member 1740 using any conventional technique, including sewing, an adhesive, welding, molding, weaving, etc. End 1774 is coupled to the shell 1702 of the hand covering 1700 using any conventional technique. In this embodiment, end 1774 is coupled proximate to the coupling region 1734. In an alternative embodiment, the elastic member 1770 can be formed integrally with elongate member 1740.

Figure 56:
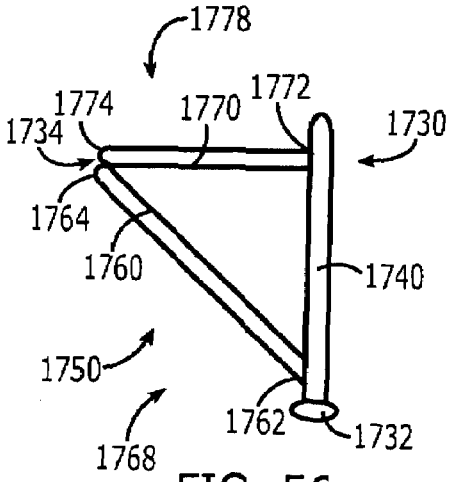
FIG. 56 is plan view of some components of the movement mechanism and the suspension mechanism of the hand covering illustrated in FIG. 54.
Figure 57:
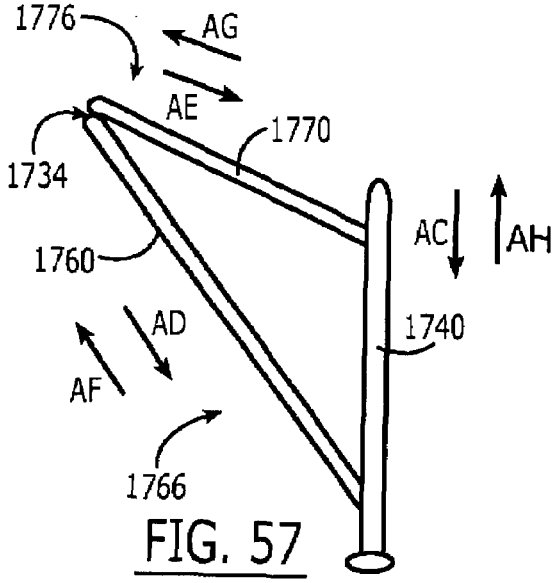
FIG. 57 is a plan view of the components of the movement mechanism and the suspension mechanism illustrated in FIG. 56 in an alternative embodiment.

Referring to FIGS. 56 and 57, different configurations of embodiments of the suspension mechanism and the movement mechanism are illustrated. In FIG. 56, the elastic members 1760 and 1770 are illustrated in their retracted or unbiased configurations 1768 and 1778, respectively. As shown, elastic members 1760 and 1770 are in their shortest configurations in the unbiased configurations.

In FIG. 57, the elongate member 1740 is illustrated in a configuration in which it has moved along the direction of arrow AC. As elongate member 1740 is pulled, it substantially retains its shape and moves. As a result, end 1762 of the elastic member 1760 moves and the elastic member 1760 is pulled along the direction of arrow AD to an extended configuration 1766. As elongate member 1740 moves, end 1772 of the elastic member 1770 moves and the elastic member 1770 is pulled along the direction of arrow AE to an extended configuration 1776.

When the user releases the elongate member 1740, elastic member 1760 moves along the direction of arrow AF and elastic member 1770 moves along the direction of arrow AG. Such movement causes the elongate member 1740 to be retracted along the direction of arrow AH. The extent of retraction of the elongate member 1740 depends on the length of the elongate member 1740 and the length and properties of the elastic members 1760 and 1770.

In an alternative embodiment, the elastic member portions 1760 and 1770 can be a single elastic member that is coupled to the shell at a central location proximate to coupling region 1734 and coupled to the elongate member 1740 at its ends.

In alternative embodiments, the locations at which the elastic members are coupled to the hand covering can be proximate to each other or spaced apart from each other. The locations and configurations of the elastic members can vary so long as the elastic members are oriented to apply forces to the elongate member to retract all or part of the elongate member into the hand covering.

Figure 58:
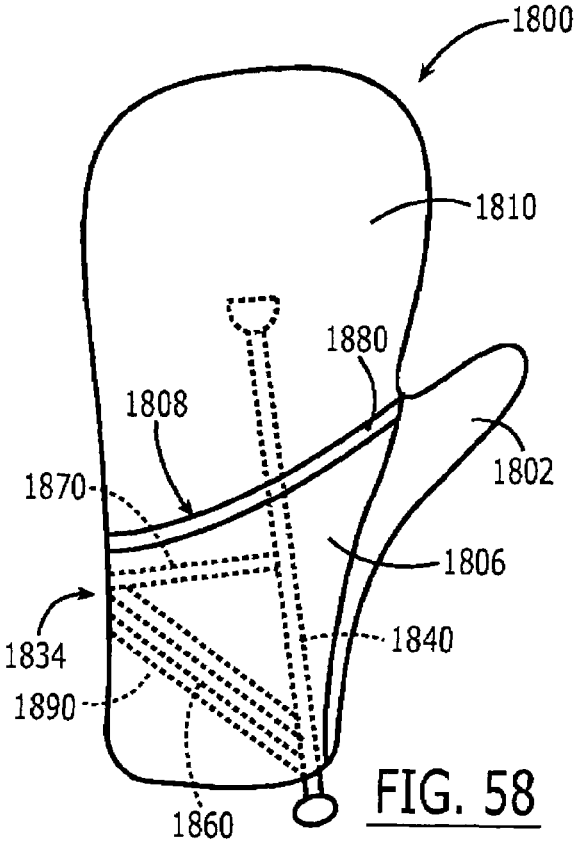
FIG. 58 is a plan view of an alternative embodiment of a hand covering according to the invention.
Figure 59A:
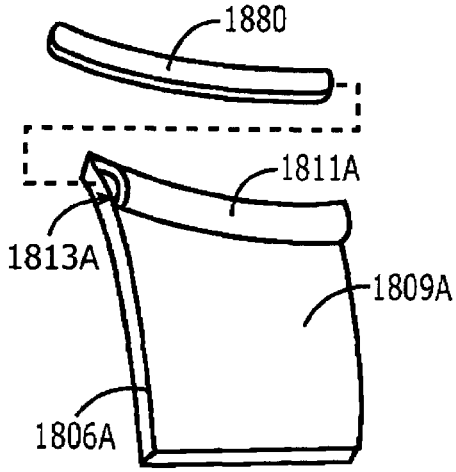
FIG. 59A is a view of an alternative embodiment of an outer layer according to the invention.
Figure 59:
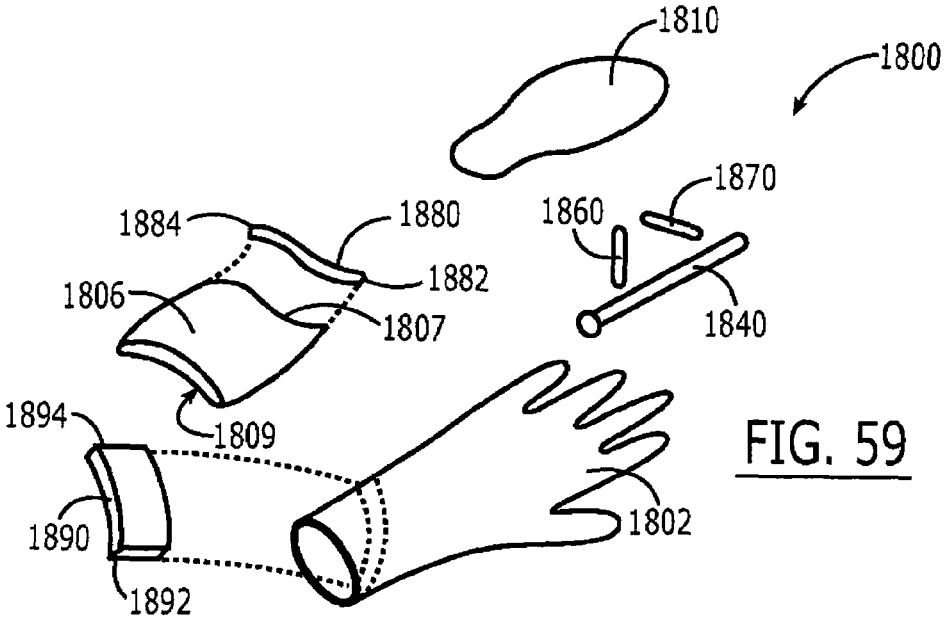
FIG. 59 is an exploded perspective view of the hand covering illustrated in FIG. 58.

An alternative embodiment of a hand covering according to the invention is illustrated in FIGS. 58 and 59. In this embodiment, the hand covering 1800 includes a shell 1802 and an outer layer 1806 that is coupled to the shell 1802 to form a receptacle 1808 therebetween. As shown in FIG. 58, the hand covering 1800 includes an elongate member 1840 and two elastic members 1860 and 1870. Members 1840, 1860, and 1870 can be similar to members 1740, 1760 and 1770 previously described.

The hand covering 1800 includes a stiffener 1880 disposed proximate to the distal edge 1807 of the outer layer 1806 (see FIG. 59). The stiffener 1880 includes ends 1882 and 1884. In this embodiment, the length of the stiffener 1880 corresponds to the length of the distal edge 1807 of the outer layer 1806. In alternative embodiments, the stiffener can be shorter than the distal edge.

The stiffener 1880 is made of a material that is more rigid than the material of the outer layer 1806. The increased strength that the stiffener 1880 provides along the distal end of the receptacle 1808 helps the outer layer 1806 retain its shape and configuration while the hood 1810 is being pulled into the receptacle 1808. The stiffener 1880 resists movement of the distal edge 1807 inwardly into the receptacle 1808 as the hood 1810 is retracted.

The stiffener 1880 can be made from any type of material. For example, the stiffener 1880 can be made from plastic, rubber, metal, binding, or any other material. In the event that the stiffener 1880 is disposed so that the hood 1810 contacts the stiffener 1880 as the hood 1810 is retracted, the material of the stiffener 1880 can also have a smooth surface or coating to reduce friction between the stiffener 1880 and the hood 1810.

The stiffener 1880 can be coupled to the outer layer 1806 using any conventional technique. For example, the stiffener 1880 can be coupled to the outer layer 1806 via sewing, adhesion, welding, or any other method.

The stiffener 1880 can be disposed so that all, part, or none of the stiffener 1880 is visible to the user on the outer layer 1806. In one embodiment, the stiffener 1880 can be coupled to an inner surface 1809 of the outer layer 1806. In another embodiment, the stiffener can be coupled to the outer surface of the outer layer 1806. In another embodiment, the stiffener can be coupled to both the inner surface and the outer surface of the outer layer 1806.

Referring to FIG. 59A, an alternative embodiment of an outer layer is illustrated. In this embodiment, the outer layer 1806A has an inner surface 1809A that has a receptacle 1811A formed thereon or coupled thereto. The receptacle 1811A can be formed by folding over a portion of the outer layer 1806A and coupling the free end. Alternatively, the receptacle 1811A can be formed by disposing a piece of material proximate to the inner surface 1809A and coupling the piece of material on both sides along its length to the outer layer 1806A.

The receptacle 1811A has a channel 1813A extending therethrough. As illustrated, the channel 1813A is configured to receive the stiffener 1880. In this embodiment, the stiffener 1880 can be removably coupled to the outer layer 1806A. Alternatively, the stiffener 1880 can be inserted and the open ends of the receptacle 1811 A can be closed using any conventional technique, such as sewing.

Referring back to FIGS. 58 and 59, the hand covering 1800 can also include another stiffener 1890. It is to be understood that in alternative embodiments, a hand covering can include one, both, or none of the stiffeners such as those described herein. The stiffener 1890 can be any type of material, as set forth in the description of stiffener 1880 above.

Stiffener 1890 has ends 1892 and 1894 and extends between opposite sides of the hand covering 1800. As shown in FIG. 58, the stiffener 1890 can be aligned with the elastic member 1860. Such an orientation reduces the movement of the coupling region 1834 (the location at which the elastic member 1860 is coupled to the hand covering 1800) toward the elongate member 1840 when the elongate member 1840 is pulled outwardly. Thus, the stiffener maintains the spacing between opposite sides of the hand covering when the elongate member 1840 is pulled.

The stiffener 1890 can be coupled to any component of the hand covering 1800. In one embodiment, the stiffener 1890 is coupled to the outer surface of the shell 1802. In other embodiments, the stiffener 1890 is coupled to either the inner surface or the outer surface of the hood 1810. In other embodiments, the stiffener 1890 can be coupled to either the inner surface or the outer surface of the outer layer 1806. The stiffener 1890 can be coupled to any of these components by sewing, adhesion, welding, bonding, or any other conventional technique.

In alternative embodiments, the length, shape and configuration of the stiffener 1890 and the orientation of the stiffener 1890 on the hand covering 1800 can vary so long as some stiffening properties are provided from side-to-side on the hand covering 1800.

Figure 60:
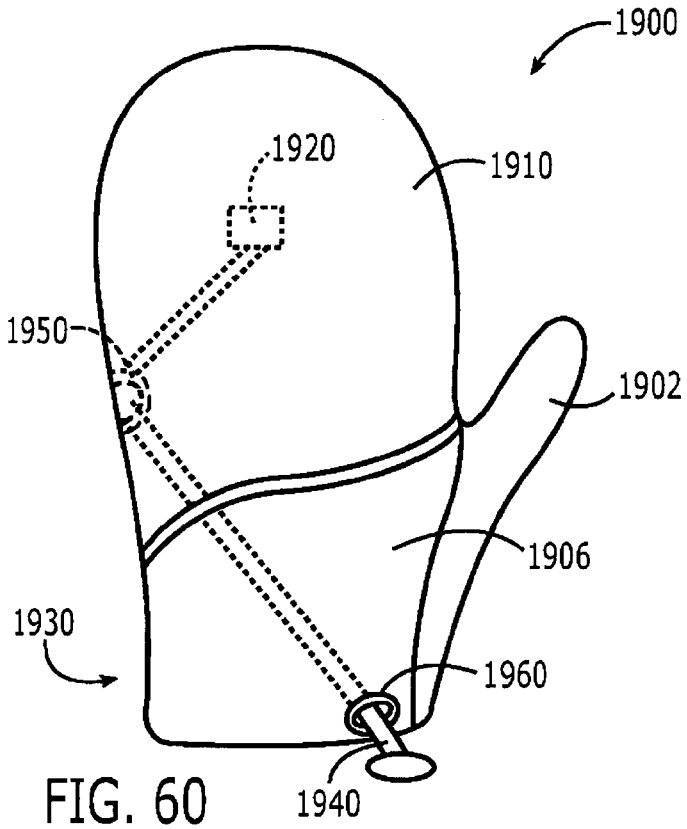
FIG. 60 is a plan view of an alternative embodiment of a hand covering according to the invention.

An alternative embodiment of a hand covering is illustrated in FIG. 60. In this embodiment, the hand covering 1900 includes a shell 1902 which has an outer layer 1906 coupled thereto to form a receptacle. The hand covering 1900 includes a hood 1910 that is movable between different configurations. The hood 1910 includes a coupler 1920 attached to an inner surface of the hood 1910.

The hand covering 1900 has a movement mechanism 1930 that includes an elongate member 1940 that is connected to the coupler 1920 and extends outwardly through a grommet 1960. The hood 1910 includes a loop 1950 that is coupled to the inner surface of the hood 1910. The loop 1950 can be made from fabric, metal, plastic or any other material that can be configured to define a channel or path through which the elongate member 1940 can be inserted.

In an alternative embodiment, the location of the loop and the quantity of loops coupled to the hood can vary. For example, the elongate member can pass through multiple loops that are coupled to the hood proximate different sides of the hood.

In an alternative embodiment, the hand covering can include a suspension mechanism with one or more elastic members coupled to the elongate member.

Figure 61:
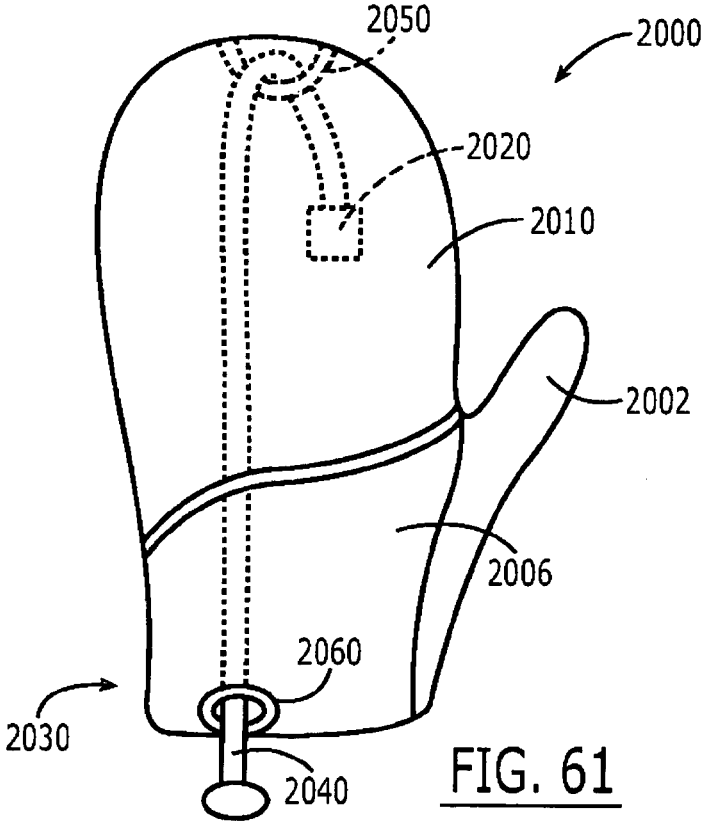
FIG. 61 is a plan view of an alternative embodiment of a hand covering according to the invention.

An alternative embodiment of a hand covering according to the invention is illustrated in FIG. 61. In this embodiment, the hand covering 2000 includes a shell 2002 with an outer layer 2006 and a hood 2010. A coupler 2020 is attached to the inner surface of the hood 2010. The movement mechanism 2030 includes an elongate member 2040 that is attached to coupler 2020 and extends outwardly through grommet 2060.

In this embodiment, a loop 2050 is disposed proximate to the distal end of the hood 2010. When a user pulls on the elongate member 2040, a pulling force is exerted on the loop 2050, thereby initially pulling the distal end of the hood 2010 toward the receptacle and the proximal end of the hand covering 2000.

In an alternative embodiment, the coupling portion of the hood does not extend to the proximal end of the shell. In another embodiment, the hood can be coupled to one of the outer layer and the back panel and not the other. In an alternative embodiment, the outer layer can be coupled to an inner surface of the shell in the interior region. In an alternative embodiment, the receptacle can be located on the palm side portion of the hand covering.

In one embodiment, the wrist portion of the hand covering includes a stretch binding that acts as a closure. In another embodiment, the hand covering includes a wrist closure mechanism, such as an adjustable strap, to seal the hand covering.

In one embodiment, the hood includes a laminating film disposed thereon. The hood can be made of nylon material. Alternatively, a polyurethane coating film can be used on the hood material as well.

While the invention has been described in detail and with references to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. A hand covering comprising:

a shell having an outer surface, the shell including at least one finger receptacle;

a layer coupled to the outer surface, the layer and the outer surface forming a receptacle therebetween;

a hood having a covering portion, the hood being coupled to the shell, the covering portion being configured to cover a portion of the finger receptacle, the covering portion being selectively disposable in a first position in which the covering portion covers the portion of the finger receptacle and in a second position in which the covering portion is disposed away from the finger receptacle and within the receptacle; and a movement mechanism, the movement mechanism being coupled to the hood and operable to move the covering portion from the first position to the second position, the movement mechanism being an elongate member, the elongate member having a first end and an opposite second end, and the elongate member passing through the receptacle with the first end being coupled to the shell and the second end being coupled to the hood.

2. The hand covering of claim 1, wherein the layer has an end, and a binding is disposed along and covers the end.

3. The hand covering of claim 1 wherein the shell includes a coupler attached thereto, the coupler being configured to receive a portion of the elongate member and retain it in a position relative to the shell.

4. The hand covering of claim 1, further comprising:

a suspension mechanism, the suspension mechanism including an elastic member coupled to the elongate member and to the shell, the elastic member having different elastic properties than the elongate member.

5. The hand covering of claim 1, wherein the hood includes a first end, a second end, and a coupling portion proximate to the first end, the coupling portion being coupled to the shell.

6. The hand covering of claim 5, wherein the movement mechanism is coupled to the hood at a location spaced apart from the coupling portion.

7. The hand covering of claim 5, wherein the movement mechanism is coupled to the hood proximate to the second end of the hood.

8. A hand covering comprising:

a shell having an outer surface, the shell having a finger portion;

a layer coupled to the outer surface, the layer and the outer surface forming a receptacle therebetween;

a hood, the hood being coupled to the shell and selectively disposable to cover the finger portion; and an elongate member having a first end and an opposite second end, the elongate member passing through the receptacle with the first end being coupled to the hood and the second end having an actuating portion extending outwardly from an opening in the receptacle, wherein a force applied to the actuating portion causes movement of the hood relative to the receptacle.

9. The hand covering of claim 8, wherein the shell has a coupler attached thereto, and the coupler being configured to retain the elongate member in a position relative to the shell.

10. The hand covering of claim 8, wherein the hood has an outer surface, an inner surface and a guide coupled to the hood inner surface, the guide being configured to receive a portion of the elongate member.

* * * * *